US009075355B2

(12) United States Patent
Chiyoda et al.

(10) Patent No.: US 9,075,355 B2
(45) Date of Patent: Jul. 7, 2015

(54) IMAGE HEATING APPARATUS

(71) Applicant: CANON KABUSHIKI KAISHA, Tokyo (JP)

(72) Inventors: Yasuharu Chiyoda, Nagareyama (JP); Kazunari Hatazaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/198,959

(22) Filed: Mar. 6, 2014

(65) Prior Publication Data

US 2014/0270868 A1 Sep. 18, 2014

(30) Foreign Application Priority Data

Mar. 12, 2013 (JP) ..... 2013-049096

(51) Int. Cl.
*G03G 15/20* (2006.01)

(52) U.S. Cl.
CPC .... *G03G 15/2025* (2013.01); *G03G 2215/0129* (2013.01)

(58) Field of Classification Search
CPC ..... G03G 15/2025; G03G 2215/0129
USPC ..... 399/67, 122, 326, 327, 400
See application file for complete search history.

(56) References Cited

U.S. PATENT DOCUMENTS

| | | | | |
|---|---|---|---|---|
| 7,460,821 | B2 | 12/2008 | Ai et al. | |
| 8,145,086 | B2 | 3/2012 | Chiyoda et al. | |
| 8,306,446 | B2 | 11/2012 | Ito et al. | |
| 8,395,090 | B2 | 3/2013 | Chiyoda | |
| 2005/0008388 | A1* | 1/2005 | Karasawa | 399/92 |
| 2005/0180786 | A1* | 8/2005 | Yamada et al. | 399/327 |
| 2006/0045585 | A1 | 3/2006 | Yoneda et al. | |
| 2007/0166084 | A1* | 7/2007 | Yoshino et al. | 399/329 |
| 2008/0038026 | A1 | 2/2008 | Ai et al. | |
| 2008/0038027 | A1* | 2/2008 | Ito et al. | 399/328 |
| 2013/0004216 | A1* | 1/2013 | Ikeda | 399/327 |
| 2013/0051826 | A1 | 2/2013 | Chiyoda | |
| 2013/0058672 | A1* | 3/2013 | Takada et al. | 399/67 |
| 2013/0108298 | A1 | 5/2013 | Chiyoda | |
| 2013/0121739 | A1 | 5/2013 | Hatazaki | |

FOREIGN PATENT DOCUMENTS

| | | | |
|---|---|---|---|
| EP | 1 564 604 | A2 | 8/2005 |
| JP | 57-181575 | A | 11/1982 |
| JP | 8-22171 | A | 1/1996 |
| JP | 2004-13026 | A | 1/2004 |
| JP | 2007065086 | A * | 3/2007 |
| JP | 2008-40364 | A | 2/2008 |

(Continued)

OTHER PUBLICATIONS

Great Britain Office Action dated Aug. 22, 2014, in counterpart UK Application No. GB1403717.0.

(Continued)

*Primary Examiner* — Francis Gray
(74) *Attorney, Agent, or Firm* — Fitzpatrick, Cella, Harper & Scinto

(57) ABSTRACT

An image heating apparatus includes: first and second rotatable members configured to form a nip for heating a toner image on a recording material; a rotatable rubbing member configured to rub the first rotatable member to substantially refresh a surface property of the first rotatable member; and an air blowing mechanism configured to blow air onto the rotatable rubbing member to clean the rotatable rubbing member.

23 Claims, 13 Drawing Sheets

(56) References Cited

FOREIGN PATENT DOCUMENTS

JP 2008-40365 A 2/2008

OTHER PUBLICATIONS

U.S. Appl. No. 14/304,173 to Kazunari Hatazaki, filed Jun. 13, 2014, Group 2852.

U.S. Appl. No. 14/197,712 to Kazunari Hatazaki, filed Mar. 5, 2014, Group 2852.

U.S. Appl. No. 14/197,640 to Kazunari Hatazaki, filed Mar. 5, 2014, Group 2852.

German Office Action issued in counterpart German Application No. 10 2014 204 379.4, dated Dec. 17, 2014.

* cited by examiner (a)

(b)

IMAGE HEATING APPARATUS

FIELD OF THE INVENTION AND RELATED ART

The present invention relates to an image heating apparatus for heating an image on a recording material.

In recent years, an image forming apparatus such as a copying machine, image forming apparatus such as a copying machine, a printer is required to realize speed-up, image quality improvement, colorization, energy saving and the like. Further, the image forming apparatus is also required to realize multimedia compatibility with various recording papers such as thick paper, roughened paper, embossed paper and coated paper, and high productivity (a print number per unit time). Accordingly, with respect to, e.g., high-gloss recording paper such as the coated paper, the image forming apparatus is also required to form an image having a higher glossiness and a higher image quality than those of a conventional image forming apparatus. In order to form the image having the higher glossiness and the higher image quality, it becomes important more than even that a surface property of a fixing roller as a heating member is stably maintained in a desired state.

However, in the conventional image forming apparatus, there is a problem such that the surface of the fixing roller (rotatable member) is gradually roughened by attack by passing of the paper and by a contaminant such as paper powder or an offset toner.

Resulting from this, there is a fear that minute unevenness (projection and recess) at the surface of the fixing roller appears as the (defective) image. That is, when the minute unevenness is generated at the surface of the fixing roller due to rubbing with the paper or inclusion of the contaminant from an outside of the fixing roller or the like, a surface shape of the fixing roller is liable to be reflected in a toner layer. Such a property is referred to as image clarity. For example, in this way, a degree of the image clarity tends to be increased due to an improvement of a toner melting property or the like, and therefore in order to form the image having the high glossiness and the high image quality, it becomes important more than ever that the surface property of the fixing roller is stably maintained in the desired state.

In an apparatus described in Japanese Laid-Open Patent Application (JP-A) 2008-40364, uneven glossiness of the image generated by a difference in manner of roughening at a surface layer of a fixing roller is made less visible on an image by using a rubbing member (refreshing roller) for repeatedly producing fine rubbing abrasion (damage) on the fixing roller. Further, in the apparatus described in JP-A 2008-40364, a cleaning roller for cleaning the rubbing member (refreshing roller) in contact with the rubbing member is contacted to the rubbing member.

However, it becomes possible to maintain a roughness of the surface layer of the fixing roller by using such a rubbing member, but on the other hand, a contaminant is gradually deposited on also the surface layer of the rubbing member every repetition of the rubbing (treatment), so that the surface property of the rubbing member is changed. In order to prevent the change in surface property, in the case where the cleaning roller as in the apparatus described in JP-A 2008-40365 is used, there is a limit to cleaning power of the cleaning roller, so that an improvement of the cleaning power has been required.

SUMMARY OF THE INVENTION

According to an aspect of the present invention, there is provided an image heating apparatus comprising: first and second rotatable members configured to form a nip for heating a toner image on a recording material; a rotatable rubbing member configured to rub the first rotatable member to substantially refresh a surface property of the first rotatable member; and an air blowing mechanism configured to blow air onto the rotatable rubbing member to clean the rotatable rubbing member.

These and other objects, features and advantages of the present invention will become more apparent upon a consideration of the following description of the preferred embodiments of the present invention taken in conjunction with the accompanying drawings.

DESCRIPTION OF THE EMBODIMENTS

A fixing device as an image heating apparatus according to the present invention and an image forming apparatus including the fixing device will be described with reference to the drawings. Incidentally, in the following embodiments, numerical values are referential numerical values and do not limit the present invention. Each of the following embodiments is an example of preferred embodiments of the present invention, but the present invention is not limited to these embodiments.

Embodiment 1

Image Forming Apparatus

Figure 1:
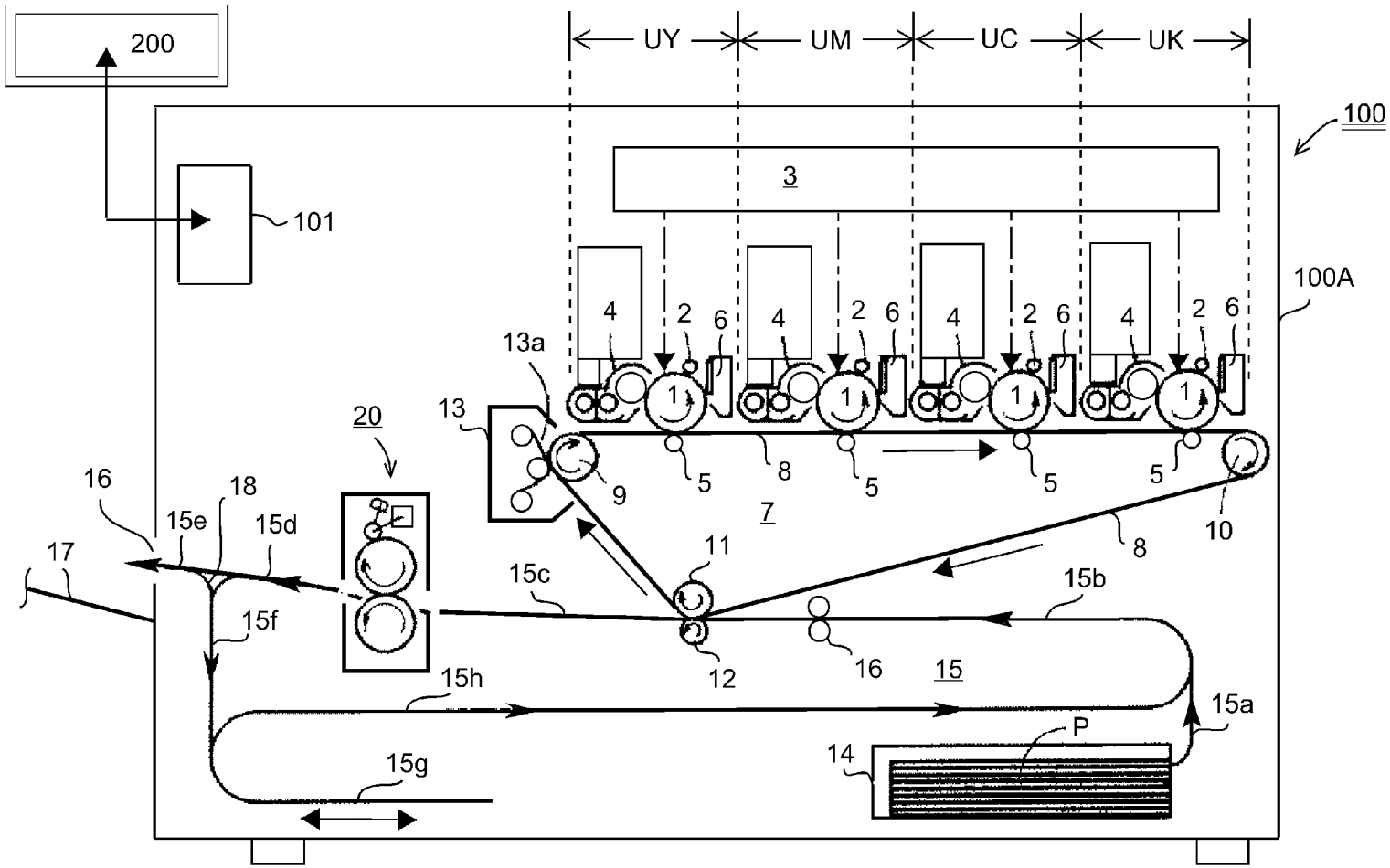
FIG. 1 is a schematic view showing a general structure of an image forming apparatus in Embodiment 1.

FIG. 1 is a schematic sectional view showing a general structure of an image forming apparatus 100 in this embodiment. The image forming apparatus 100 is an electrophotographic full-color laser printer of an in-line (tandem) type and an intermediary transfer type. That is, the image forming apparatus 100 is capable of forming a full-color image on a recording material (recording paper) P in accordance with electrical image information inputted from a host device 200 such as a personal computer into a control circuit portion (controller) 101.

In a main assembly 100A of the image forming apparatus 100, from left to right in FIG. 1, first to fourth (four) image forming portions U (UY, UM, UC, UK) are horizontally provided in line at predetermined intervals. The respective image forming portions U are different in color of images to be formed thereby but are the same electrophotographic process mechanism.

That is, each of the image forming portions U includes a drum-type electrophotographic photosensitive member (hereinafter referred to as a drum) 1 as an image bearing member to be rotationally driven at a predetermined peripheral speed in the counterclockwise direction indicated by an arrow. Further, the image forming apparatus 100 includes, as process means actable on the drum 1, a charger (charging roller) 2, a developing device 4, a primary transfer charger (primary transfer roller) 5 and a drum cleaner 6.

The charger 2 electrically charges a surface of the drum 1 uniformly to a predetermined polarity and a predetermined potential. The developing device 4 develops an electrostatic latent image, formed on the drum 1, with a developer (hereinafter referred to as a toner). The primary transfer charger 5 primary-transfers a toner image, formed on the drum 1, onto a transfer belt 8 described later. The drum cleaner 6 cleans the drum surface after the transfer of the toner image onto the transfer belt 8.

The first image forming portion UY accommodates a toner of yellow (Y) in the developing device 4, and forms the toner image of Y on the drum 1. The second image forming portion UM accommodates a toner of magenta (M) in the developing device 4, and forms the toner image of M on the drum 1. The third image forming portion UC accommodates a toner of cyan (C) in the developing device 4, and forms the toner image of C on the drum 1. The fourth image forming portion UK accommodates a toner of black (K) in the developing device 4, and forms the toner image of K on the drum 1.

Above the first to fourth image forming portions U, a laser scanner 3 is provided. The laser scanner 3 exposes the drum 1 of each image forming portion U to light corresponding to the image information thus forming the electrostatic latent image on the drum 1. Although illustration is omitted, a light source device and a polygon mirror are provided inside the laser scanner 3. The surface of the drum 1 is scanned with laser light, emitted from the light source device, by rotation of the polygon mirror. Then, a light flux of the scanning light is deflected by a reflection mirror and then is focused on generatrix of the drum 1 of each image forming portion U by an fθ lens to effect main scanning (light) exposure. As a result, on the drum 1 of each image forming portion U, the latent image depending on an associated image signal is formed.

At a lower portion of the first to fourth image forming portions U, an intermediary transfer belt unit 7 is provided. This unit 7 includes a driving roller 9 in the first image forming portion UY side, a tension roller 10 in the fourth image forming portion UK side, and a secondary transfer opposite roller 11 downstream of the driving roller 9 with respect to a belt rotation direction. Further, an intermediary transfer belt (hereinafter referred to as a belt) 8 as a flexible endless belt extended and stretched around these three rollers 9, 10 and 11 is provided.

The primary transfer charger 5 of each image forming portion U is provided inside the belt 8, and opposes a lower surface of the corresponding drum 1 via an upper belt portion of the belt 8 contacting the drum 1 and the charger 5. At each image forming portion U, a contact portion between the drum 1 and the belt 8 is primary transfer portion. The belt 8 is rotated in the clockwise direction, indicated by an arrow, by the driving roller 9 at the substantially same speed as a peripheral speed of the drum 1. The secondary transfer roller 12 is contacted to the belt 8 toward the secondary transfer opposite roller 11. A contact portion between the belt 8 and the secondary transfer roller 12 is a secondary transfer portion.

At a belt contact portion of the driving roller 9, a belt cleaner 13 is provided. This cleaner 13 cleans, with a cleaning web (nonwoven fabric) 13*a*, a belt surface after the secondary transfer of the toner image from the belt 8 onto the recording paper P. Below the intermediary transfer belt unit 7, a sheet feeding cassette 14 accommodating the recording paper P and a recording paper feeding mechanism 15 are provided.

A full-color image forming operation is as follows. The image forming apparatus 100 performs the image forming operation, so that the toner image of Y corresponding to a Y-component of the full-color image is formed on the drum 1 of the first image forming portion UY. The toner image is primary-transferred onto the belt 8 at the primary transfer portion. The toner image of M corresponding to an M-component of the full-color image is formed on the drum 1 of the second image forming portion UM. The toner image is primary-transferred, at the primary transfer portion, superposedly onto the toner image of Y which has already been transferred onto the belt 8.

The toner image of C corresponding to a C-component of the full-color image is formed on the drum 1 of the third image forming portion UC. The toner image is primary-transferred, at the primary transfer portion superposedly onto the toner images of Y and M which have already been transferred onto the belt 8. The toner image of K corresponding to an K-component of the full-color image is formed on the drum 1 of the fourth image forming portion UK. The toner image is primary-transferred, at the primary transfer portion, superposedly onto the toner images of Y, M and C which have already been transferred onto the belt 8.

The primary transfer of the toner image from the drum 1 of each image forming portion U onto the belt 8 is carried out by applying a bias, to the primary transfer charger 5, of an opposite polarity to a normal charge polarity of the toner. In this way, a full-color (unfixed) synthetic color toner image based on the toner images of Y, M, C and K is formed on the belt 8. The synthetic color toner image is formed on the recording paper P while leaving a certain margin from each of four edges of the recording paper P. In this embodiment, a leading end margin is about 2-3 mm.

On the other hand, one sheet of the recording paper P is separated and fed from the sheet feeding cassette 14 at predetermined control timing, and is sent to a registration roller pair 16 after passing through recording papers 15*a* and 15*b* of the recording paper feeding mechanism 15. Then, the recording paper P is introduced into the secondary transfer portion by the registration roller pair 16 at predetermined control timing. As a result, in a process in which the recording paper P is nipped and fed through the secondary transfer portion, the superposed four color toner images on the belt 8 are successively and collectively secondary-transferred onto the surface of the recording paper P. This secondary transfer is carried out by applying a bias, to the secondary transfer roller 12, of an opposite polarity to the normal charge polarity of the toner.

Then, the recording paper P on which the toner images are secondary-transferred passes through a paper path 15*c* and is introduced into a fixing device 20 to be subjected to fixing, thus being discharged, as a full-color image-formed product, onto a sheet discharge tray 17 via paper paths 15*d* and 15*e* and a discharging opening 16.

The image forming apparatus 100 is not limited to an image forming apparatus for forming the above-described full-color image, but is also capable of forming a desired single color image such as a monochromatic image or a desired multi-color image. In this case, of the first to fourth image forming portions, only the image forming portion required for forming the desired single color or multi-color image performs the image forming operation. The unnecessary image forming portions are controlled so that the drums 1 are rotationally driven but do not perform the image forming operation.

Also double-side printing is capable of being effected. In this case, the recording paper P, which has already been subjected to one-side image formation, coming out of the fixing device 20 is changed in course to a paper path 15*f* by a flapper 18 and then is guided into a paper path 15*h* for double-side printing (or re-feeding) via a reversing path (switch-back path) 15*g*. Then, the recording paper P is guided again into the paper path 15*b* and is sent to the secondary transfer portion in a state in which the recording paper P is turned upside down. As a result, the secondary transfer of the toner images onto the other surface of the recording paper P is carried out. Thereafter, the recording paper P passes through the same path as that in the case of the one-side printing, i.e., passes through the paper path 15*c*, the fixing device 20, the paper paths 15*d* and 15*e* and the discharging operation 16, and is discharged, as a double-side image-formed product, onto the sheet discharge tray 17.

Here, the fixing device 20 provided in the image forming apparatus 100 in this embodiment is constituted so as to fix the toner image, formed on the recording material (recording paper) with a toner containing a parting agent, by heating and pressing the toner image in an oil-less manner.

The toner used for the image formation contains (incorporates), as the parting agent, a wax such as paraffin or polyolefin, or silicone oil. Specifically, in this embodiment, a pulverized toner in which a wax component and a pigment are fixed dispersed is used. Incidentally, a constitution in which a polymerization toner contains such a wax component may also be employed. In the following description, as the parting agent, the wax will be described as an example, but is the same even in the case where the silicone oil is used as the parting agent as described above.

<Fixing Device>

Figure 2:
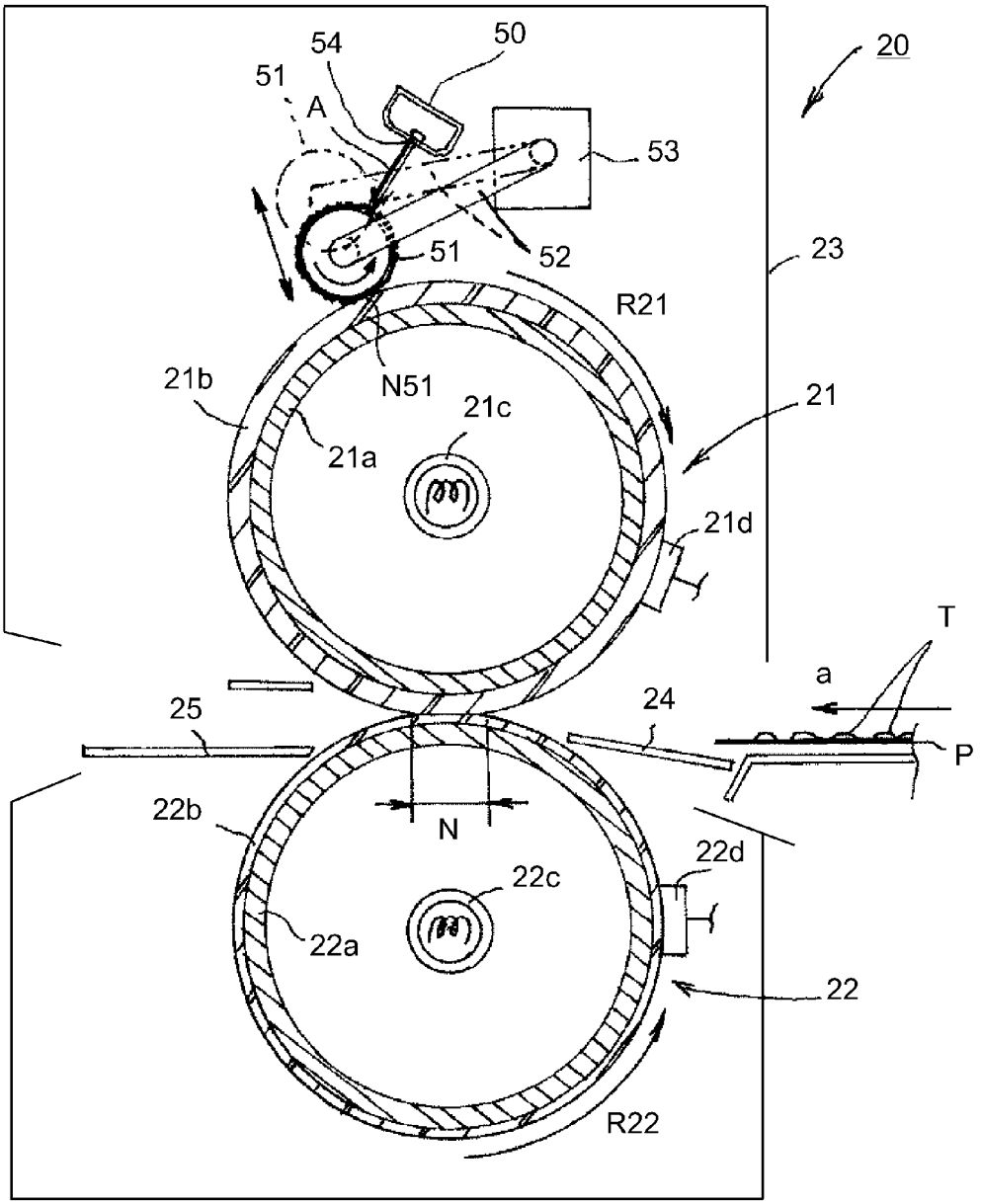
FIG. 2 is an enlarged schematic cross-sectional view of a fixing device.
Figure 3:
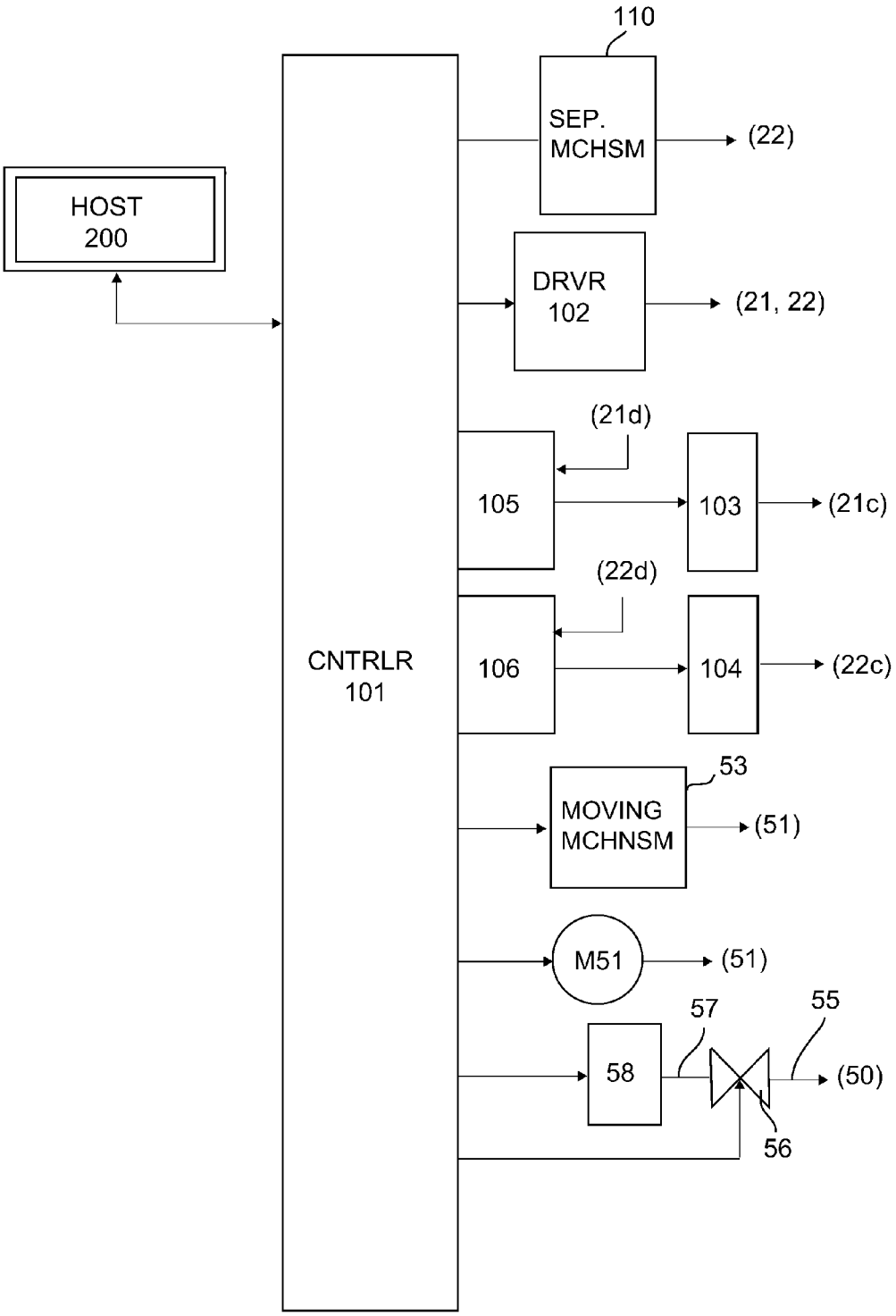
FIG. 3 is a block diagram of a control system of the fixing device.

FIG. 2 is an enlarged schematic cross-sectional view of the fixing device 20 in this embodiment. FIG. 3 is a block diagram of a control system of this fixing device 20. The fixing device 20 is of a heating roller pair type and of an oil-less fixing type, and includes a press-contact roller pair consisting of a fixing roller 21 as a rotatable heating member (first rotatable member in this embodiment: heating member) and a pressing roller 22 as a rotatable pressing member (second rotatable member in this embodiment: pressing member). By the roller pair 21 and 22, a nip for heating the toner image (image) on the recording material (recording paper) is formed.

The fixing roller 21 has a parting layer as a surface layer. The parting layer is 10 μm or more and 60 μm or less in the thickness, and is D40 or more and D90 or less in hardness as measured by Shore hardness tester. The parting layer is formed of a fluorine-containing resin material. The fixing roller 21 is a hollow roller, of 60 mm in diameter, prepared by disposing a 3 mm-thick elastic layer 21*b* on an outer peripheral surface of an aluminum-made cylindrical core metal 21*a*. The elastic layer 21*b* has a composite layer structure consisting of a lower layer and an upper layer as a heat-resistant elastic layer (parting layer) to be contacted to the image surface of the recording paper P. The lower layer is HTV (high-temperature vulcanizing type) silicone rubber layer. The upper layer is disposed on an outer peripheral surface of the lower layer and is RTV (room-temperature vulcanizing type) silicone rubber layer.

The fixing roller 21 is fixedly disposed while being horizontally supported rotatably by ball bearings (not shown between opposing side plates of a fixing device casing 23 at end portions thereof. At a rotation center portion inside the fixing roller 21, a halogen heater 21*c* for heating the fixing roller 21 from an inside is provided in a non-rotational manner.

The pressing roller 22 is constituted so as to be 60 mm in diameter by disposing a 1 mm-thick elastic layer 22*b* on an outer peripheral surface of an aluminum-made cylindrical core metal 22*a*. The elastic layer 22*b* has a composite layer structure consisting of a lower layer and an upper layer to be contacted to the back surface of the recording paper P. The lower layer is HTV silicone rubber layer. The upper layer is disposed on an outer peripheral surface of the lower layer and is a fluorine-containing resin layer.

The pressing roller 22 is disposed in parallel with the fixing roller 21 in a lower side of the fixing roller 21, and is disposed while being supported rotatably by ball bearings (not shown between opposing side plates of the fixing device casing 23 at end portions thereof. At a rotation center portion inside the pressing roller 22, a halogen heater 22*c* for heating the pressing roller 22 from an inside is provided in a non-rotational manner.

The ball bearings at the end portions of the pressing roller 22 are disposed, between the opposing side plates of the fixing device casing 23, with a degree of freedom of movement so as to be slidably moved in a direction toward the fixing roller 21. The pressing roller 22 is urged by an urging member (not shown) so as to be moved in the direction of the fixing roller 21.

As a result, the pressing roller 22 is press-contacted to the fixing roller 21 at a predetermined force against elasticity of the elastic layers 21*b* and 22*b*, so that a fixing nip (heating nip) N having a predetermined width with respect to a feeding direction a of the recording paper (recording material) P is formed between the rollers 21 and 22. In this embodiment, the pressing roller 22 is press-contacted to the fixing roller 21 at a total pressure of about 784N (about 80 kgf).

The fixing roller 21 and the pressing roller 22 are connected with each other by engaging gears, fixed thereon at one shaft end portions thereof, by using a gear mechanism, and receive a driving force transmitted from a driving portion 102 controlled by the control circuit portion 101. As a result, the fixing roller 21 and the pressing roller 22 are rotationally driven at predetermined peripheral speeds in directions of arrows R21 and R22, respectively, i.e., in a direction in which the recording paper P is to be nipped and fed at the nip N.

Further, the pressing roller 22 is, under a predetermined control condition, moved downward against an urging force of the above-described urging member by a fixing and spacing mechanism 110 controlled by the control circuit portion 101, thus being maintained in a spaced state from the fixing roller 21 (pressing roller spacing operation). That is, the pressing roller 22 is kept in a state in which the formation of the fixing nip N is eliminated. Although a specific example of the fixing and spacing mechanism 110 is omitted from illustration, it is possible to use a mechanism, including a cam and a lever, or the like controlled by the control circuit portion 101 can be used.

The halogen heaters 21*c* and 22*c* of the fixing roller 21 and the pressing roller 22 are supplied with electric power from power source portions 103 and 104 (FIG. 3), respectively, to generate heat. By this heat generation, each of the fixing roller 21 and the pressing roller 22 is internally heated, so that a surface temperature is increased. To the surfaces of the fixing roller 21 and the pressing rollers 22, thermistors (temperature detecting means) 21*d* and 22*d* for detecting temperatures of the respective rollers are contacted and provided. Further, pieces of temperature information detected by the thermistors 21*d* and 22*d* are inputted into temperature adjusting circuit portions 105 and 106, respectively, of the control circuit portion 101.

The temperature adjusting circuit portion 105 adjusts the electric power supplied from the power source portion 103 to the halogen heater 21*c* so that the surface temperature of the fixing roller 21 detected by the thermistor 21*d* is temperature-controlled by converging to a predetermined temperature (about 165° C. in this embodiment). The temperature adjusting circuit portion 106 adjusts the electric power supplied from the power source portion 104 to the halogen heater 22*c* so that the surface temperature of the pressing roller 22 detected by the thermistor 22*d* is temperature-controlled by converging to a predetermined temperature (about 140° C. in this embodiment).

The pressing roller 22 is contacted to the fixing roller 21 (pressing roller contacting operation), and the fixing roller 21 and the pressing roller 22 are driven, and then the respective surface temperatures of these rollers are increased to the predetermined temperatures, thus being temperature-controlled. In this state, the recording paper P on which the (unfixed) toner image (unheated toner image) T is formed is introduced from the image forming portion side into the fixing device 20. A recording paper guiding plate 24 is provided in an entrance side.

The recording paper P enters the nip N while opposing the fixing roller 21 in the (unfixed) toner image carrying surface side, and is nipped and fed through the nip N, so that the (unfixed) toner image T is fixed as a fixed image on the surface of the recording paper P under application of heat and pressure. The recording paper P passing through the nip N is separated from the fixing roller 21 and comes out of the fixing device 20 along an exit-side recording paper guiding plate 25.

By combining the fixing roller 21 with the pressing roller 22 which have the above-described layer structures, a parting property with respect to a sharp-melt toner is further improved. Further, in order to fix the both-side images, not only at the surface of the fixing roller 21 but also at the surface of the pressing roller 22, the RTV or LTV (low temperature vulcanizing type) silicone rubber having a high toner parting effect is used.

<Abrasion (Damage) by Paper Edge>

Abrasion (damage) by paper edge relating to a purpose of surface modification of the fixing roller 21 will be described. At an edge portion of the recording paper P, there is a burr generated when the paper is cut. For that reason, a degree of an attack by the recording paper P is larger in a fixing roller region, corresponding to the paper edge portion, than a fixing roller region corresponding to a portion other than the paper edge portion, so that a surface roughness Rz of the fixing roller 21 in the fixing roller region (corresponding to the paper edge portion) is gradually increased to about 1.0-2.0 μm. This burr of the paper is liable to generate when a cutting edge is abraded in a cutting step from a large-sized paper to lower sharpness thereof. In the region other than the edge region, an amount of a change in surface roughness from an initial state is small, so that a difference in surface roughness is generated between the paper edge portion and a non-paper edge portion.

Next, a surface state of the fixing roller 21 and uneven glossiness on the image will be described. When the (unfixed) toner image is fixed on the recording paper P, the fixing device 20 applies the pressure and the heat to the recording paper P. At this time, a minute surface state of the fixing roller 21 is transferred onto the surface of the toner image after the fixing. When the surface state on the fixing roller 21 varies, a difference in surface state is correspondingly generated on the toner image. As a result, uneven glossiness on the image is generated.

Accordingly, particularly, in the case where the image is fixed on a high-gloss coated paper or the like required to provide a high image quality, a low-gloss stripe is generated at a position (roughed position), corresponding to the paper edge portion, of the fixing roller 21, so that the uneven glossiness is generated on the image.

Therefore, in the fixing device 20 in this embodiment, a refreshing roller 51 which is a rotatable rubbing member as a rubbing member provided with a rubbing material is provided. An operation (rubbing or refreshing operation) in a surface modifying operation mode in which the refreshing roller 51 is contacted to the fixing roller 21 as the rotatable heating member to rub the fixing roller 21 to substantially refresh (recover) a surface property of the fixing roller 21 is carried out.

Incidentally, in this embodiment, by the rubbing with the refreshing roller 51, a level of the surface property may be not only a level such that the surface property of the fixing roller 21 is sufficiently recovered to that at an unused state but also a level such that the surface property of the fixing roller 21 is improved (recovered) to the extent that the above-described abrasion (damage) by the paper edge is not conspicuous on the image. That is, the wording "the surface property of the fixing roller is substantially recovered (refreshed)" means that the surface property of the fixing roller is improved so that the fixing roller surface property can be maintained within a range of such a level.

That is, the refreshing roller 51 is a member for recovering (refreshing) the surface property of the fixing roller 21 by rubbing the surface of the fixing roller 21, and provide many minute rubbing abrasions (damages) to both the surface, of the fixing roller, roughened by the passing of the recording paper P and the surface, of the fixing roller, which is not roughened by passing of the recording paper P. As a result, the glossiness difference on the image is made visually unrecognizable.

The refreshing roller 51 provides the rubbing abrasion to the fixing roller 21 without substantially scraping off the surface of the fixing roller 21. The surface of the fixing roller 21 is roughened at a desired level by using the refreshing roller 51 to uniformize the surface state of the fixing roller 21, so that the glossiness difference on the image can be eliminated. That is, the minute rubbing abrasions are superposed on the surface of the fixing roller 21 by the rubbing with the refreshing roller 51, so that the uneven image glossiness generated by a difference in roughened state of the fixing roller surface layer is less visually recognizable on the image.

Specifically, e.g., the fixing roller 21 provided with the parting layer, as the surface layer, of the fluorine-containing resin material is about 0.1-0.3 μm in surface roughness Rz at the non-roughened surface of the fixing roller 21 and is about 0.5-2.0 μm in surface roughness Rz at the roughed surface (recessed portion with no directionality).

On the other hand, in this embodiment, by the rubbing with the refreshing roller 51, the rubbing abrasion (minute recessed portion with directionality) such that a resultant surface roughness Rz is 0.5 μm or more and 2.0 μm or less is provided on the fixing roller 21 along the rotational direction of the fixing roller 21. Moreover, by a rubbing material 51A (FIG. 4), rubbing abrasions each of 10 μm or less in width are formed in an amount of 10 lines or more per 100 μm with respect to a rotational axis direction. As a result, the surface of the fixing roller 21 is recovered (repaired).

Further, the image forming apparatus 100 performs an operation in a refreshing roller cleaning mode (cleaning) in which air is blown onto the refreshing roller 51 to maintain the surface roughness of the refreshing roller 51. As a result, even after the operation in the surface modifying operation mode of the fixing roller 21 by the refreshing roller 51 is repeated plural times, deposition of a contaminant between portions of the abrasion material at the refreshing roller surface layer is alleviated, so that it becomes possible to maintain the roughness of the refreshing roller surface layer.

Accordingly, a stable refreshing operation can be performed, so that the surface property of the fixing roller 21 can be maintained for a long term. A maintenance interval of the refreshing roller 51 and a refreshing roller cleaning member (rotatable rubbing member cleaning member) 80 (FIG. 17) described later can be remarkably reduced.

<Rotatable Rubbing Member>

Figure 4:
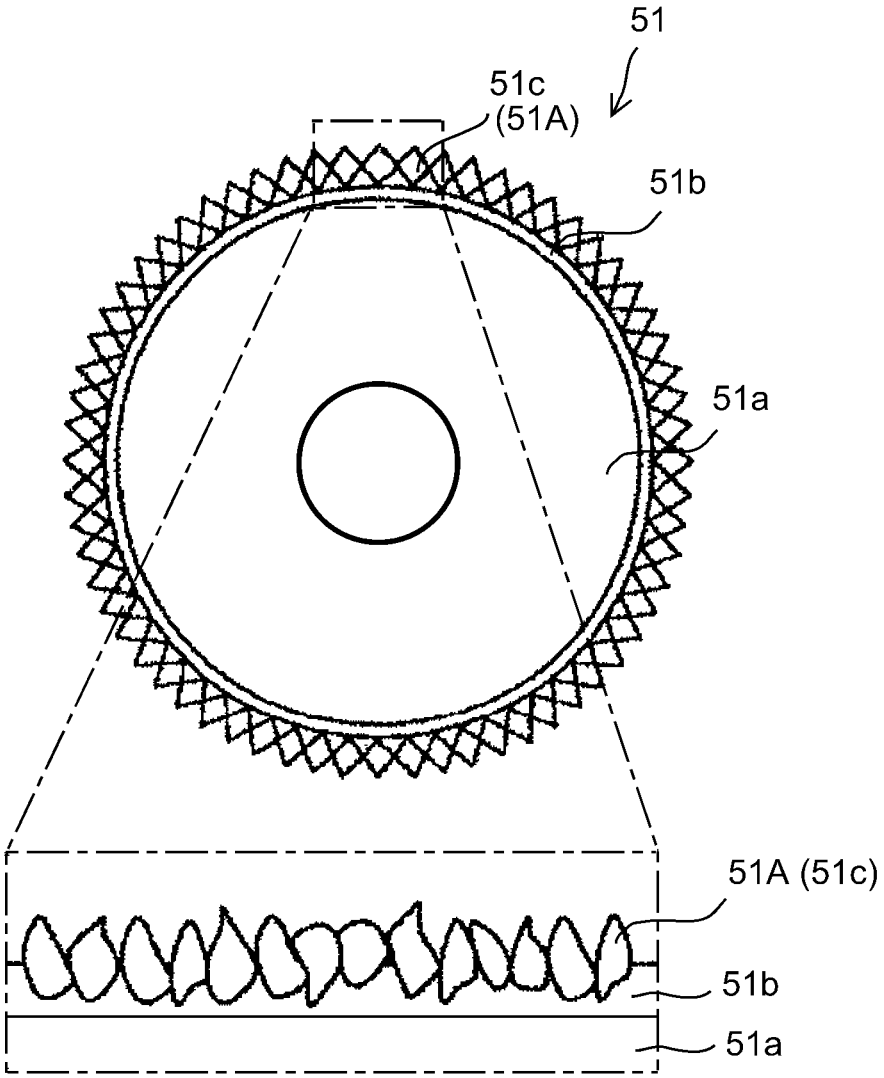
FIG. 4 is a schematic view for illustrating a refreshing roller.

A constitution of the refreshing roller 51 as the rotatable rubbing member will be described. FIG. 4 is a schematic structural view of the refreshing roller 51. The refreshing roller 51 is prepared by providing, onto a core metal (base material) 51*a* formed of SUS304 (stainless steel) in an outer diameter of 12 mm, a rubbing layer (surface layer) 51*c* formed by densely applying (bonding) abrasive grains as the rubbing material 51A via an adhesive layer (intermediate layer) 51*b*.

A size (particle size) of the abrasive grains as the rubbing material 51A constituting the rubbing layer 51*c* as the surface layer of the refreshing roller 51 may desirably be 5 μm or more and 20 μm or less. The abrasive grains 51A are densely provided at the surface layer 51*c*. Accordingly, it is preferable that the surface layer 51*c* of the refreshing roller 51 is constituted by particles of 5 μm or more and 20 μm or less in particle size and has a thickness of 3 μm or more and 20 μm or less. Below this range, a rubbing effect by the refreshing roller 51 is decreased. On the other hand, above this range, there is a fear that the surface of the fixing roller 21 is abraded or damaged to the extent that the image is adversely affected.

As the abrasive grains, it is possible to use particles of aluminum oxide, aluminum oxide hydroxide, silicon oxide, cerium oxide, titanium oxide, zirconia, lithium silicate, silicon nitride, silicon carbide, iron oxide, chromium oxide, antimony oxide, diamond, and the like. It is also possible to use some abrasive grains of mixtures of these particles which are subjected to adhesive bonding treatment via the adhesive layer. In this embodiment, as the rubbing material 51A, white alundum (WA) of about 12 μm in average particle size was used. Alumina (aluminum oxide)-based material (which is also called "alundum" or "molundam") is the abrasive grain which is most widely used and has a sufficiently high hardness compared with the fixing roller 21 and a contour of the particle has an acute-angle shape. Therefore, the alumina-based material is excellent in machineability and is suitable as the rubbing material 51A. Here, the particle size of the abrasive grains can be obtained by randomly extracting 100 or more particles of the abrasive grains by using a scanning electron microscope ("S-4500", manufactured by Hitachi, Ltd.) and then by calculating a number-average particle size by using an imaging process analyzing apparatus ("Luzex 3", manufactured by Nireco Corp.).

The refreshing roller 51 is rotatably supported by a supporting member 52 provided at each of end portions of the core metal 51*a* with respect to a longitudinal direction (rotational axis direction). Further, the supporting member 52 is swung by a contact and separation mechanism (spacing mechanism) 52 controlled by the control circuit portion 101 so that the refreshing roller 51 can be contacted to and spaced (separated) from the fixing roller 21. Further, with respect to the refreshing roller 51, the supporting member 52 provided at each of the longitudinal end portions is, during the contact and rotation operation with respect to the fixing roller 21, urged at a total pressure of 30N in this embodiment by a pressing spring (not shown) as an urging means. A contact pressure of the refreshing roller 51 may preferably be in a range of 50 g/cm or more and 150 g/cm or less. As a result, the refreshing roller 51 is pressed against the fixing roller 21, so that a rubbing nip (contact nip) N51 having a predetermined width with respect to a surface movement direction of each of the rollers is formed the refreshing roller between 51 and the fixing roller 21.

The refreshing roller 51 may also be rotated so that the surface movement directions of the refreshing roller 51 and the fixing roller 21 are either of the same direction and the opposite directions at the rubbing nip 51 with the fixing roller 21. In a preferred example, a peripheral speed difference is provided between the fixing roller 21 and the refreshing roller 51.

For example, rotation of the refreshing roller 51 in a counter direction (opposite direction) to the fixing roller 21 at the peripheral speed difference (peripheral speed ratio) of 70% relative to the fixing roller 21 means the following rotation. For example, in the case where the peripheral speed of the fixing roller 21 is 220 mm/sec, the refreshing roller 51 is rotated at the peripheral speed of 66 mm/sec so as to be moved in the counter direction to the fixing roller 21 at the rubbing nip N51 with the fixing roller 21.

The peripheral speed of the fixing roller 21 is taken as V (mm/sec), and the peripheral speed of the refreshing roller 51 is taken as V (mm/sec). Further, the peripheral speed V of the fixing roller 21 is a positive value, and the peripheral speed v of the refreshing roller 51 is a positive value in the case where the surface movement directions of these rollers 21 and 51 are the same at the rubbing nip N51 between the rollers 21 and 51, and is a negative value in the case where the surface movement directions of the rollers 21 and 25 are the opposite directions. At this time, a value calculated by: $(|V-v|/V)\times 100$ is defined as the above-described peripheral speed ratio.

Further, the contact pressure (g/cm) of the refreshing roller 51 can be obtained by measuring a planar contact pressure by a planar contact pressure distribution measuring system ("I-SCAN", manufactured by Nitta Corp.) and then by dividing the planar contact pressure by a contact width (with respect to the rotational axis direction). Incidentally, the measurement was carried out in a state in which both the fixing roller 21 and the refreshing roller 51 are at rest.

The peripheral speed difference (peripheral speed ratio) of the refreshing roller 51 relative to the fixing roller 21 may preferably be in a range of 50% or more and 100% or less when the surface movement directions of the rollers 21 and 25 are the opposite directions at the rubbing nip N51. On the other hand, the peripheral speed difference of the refreshing roller 51 relative to the fixing roller 21 may preferably be in a range of 250% or more and 300% or less when the surface movement directions of the rollers 21 and 25 are the same at the rubbing nip N51. With respect to a frictional force of the refreshing roller 51 relative to the fixing roller 21, it would be considered that the peripheral speed difference between the refreshing roller 51 and the fixing roller 21 is important, and when a desired peripheral speed difference is obtained, the rotational direction of the refreshing roller 51 may also be either of the same direction and the opposite direction.

As described above, the refreshing roller 51 has the layer structure consisting of at least three layers including the base material 51*a*, the intermediary layer 51*b* and the surface layer 51*c*. The surface layer 51*c* includes the abrasive grains as the rubbing material 51A. The intermediary layer 51*b* is an elastic layer. In this embodiment, the adhesive layer as the intermediary layer 51*b* functions as the elastic layer.

The refreshing roller 51 is capable of not only uniformly rubbing the surface of the fixing roller 21 but also achieving the following effect. That is, the intermediary layer 51*b* is the elastic layer, and therefore even when the toner image is included between the refreshing roller 51 and the fixing roller 21 during the rubbing operation, such an effect that the contaminant is covered with the elastic layer 51*b*. As a result, such an action that sudden generation of sharp abrasions on the fixing roller 21 due to the paper powder, the externally included contaminant and the like is suppressed is obtained.

As a result, it is possible to prevent image defect visualized on the image by transferring the abrasions onto the image. Further, by the elastic layer 51*b*, the rubbing nip N51 between the refreshing roller 51 and the fixing roller 21 can be broadened, so that a better rubbing characterized can be maintained. In this embodiment, a minute hardness of the surface layer 51*c* of the refreshing roller 51 was 0.07 GPa.

The minute hardness of the surface layer 51*c* of the refreshing roller 51 may be 0.03 GPa or more and 1.0 GPa or less. In the case where the minute hardness is in the range from 0.03 GPa to 1.0 GPa, the abrasive grains 51A were not buried in the adhesive layer 51*b* at the nip N51, and therefore a good durability (characteristic) was able to be obtained. On the other hand, in the case where the minute hardness is 2.0 GPa or 3.0 GPa, the abrasions caused due to the contaminant (e.g., the paper powder, the carrier of the developer, or the like) included between the refreshing roller 51 and the fixing roller 21 by continuous rotation of these rotations were generated on the fixing roller 21.

As a result, image stripes were visualized on the image. From this result, the minute hardness (GPa) of the surface of the refreshing roller 51 may desirably be 0.03 GPa or more and 1.0 GPa or less.

As the material (elastic material rubber or elastomer) for the elastic layer 51*b*, e.g., it is possible to use butyl rubber, fluorine-containing rubber, acrylic rubber, EPDM, NBR, acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, and syndiotactic 1,2-butadiene.

Further, it is also possible to use epichlorohydrin rubber, silicone rubber, fluorine-containing rubber, polysulfide rubber, polynorbonene rubber, hydrogenated nitrile rubber, and thermoplastic elastomers (e.g., those based on polystyrene, polyolefin, polyvinyl chloride, polyurethane, polyurea, polyester, fluorine-containing resin, and the like).

Further, one or two or more species of the rubbers or elastomers selected from the above materials can be used. However, the material for the elastic layer 51*b* is not limited to the materials described above. Further, the elastic layer 51*b* may preferably be a layer which is 20μ or more and 60 μm or less in thickness and which is formed with an elastic member having JIS-A hardness (under a load of 1 kg) of 40 degrees or more and 70 degrees or less. As a result, the generation of the abrasions on the surface of the fixing roller 21 can be prevented by covering the contaminant included between the fixing roller 21 and the refreshing roller 51 during the continuous rotation. In this embodiment, the silicone rubber member having the JIS-A hardness of 40 degrees was used as the elastic layer 51*b*. Further, in this embodiment, the thickness of the elastic layer 51*b* was 40 μm.

Figure 5:
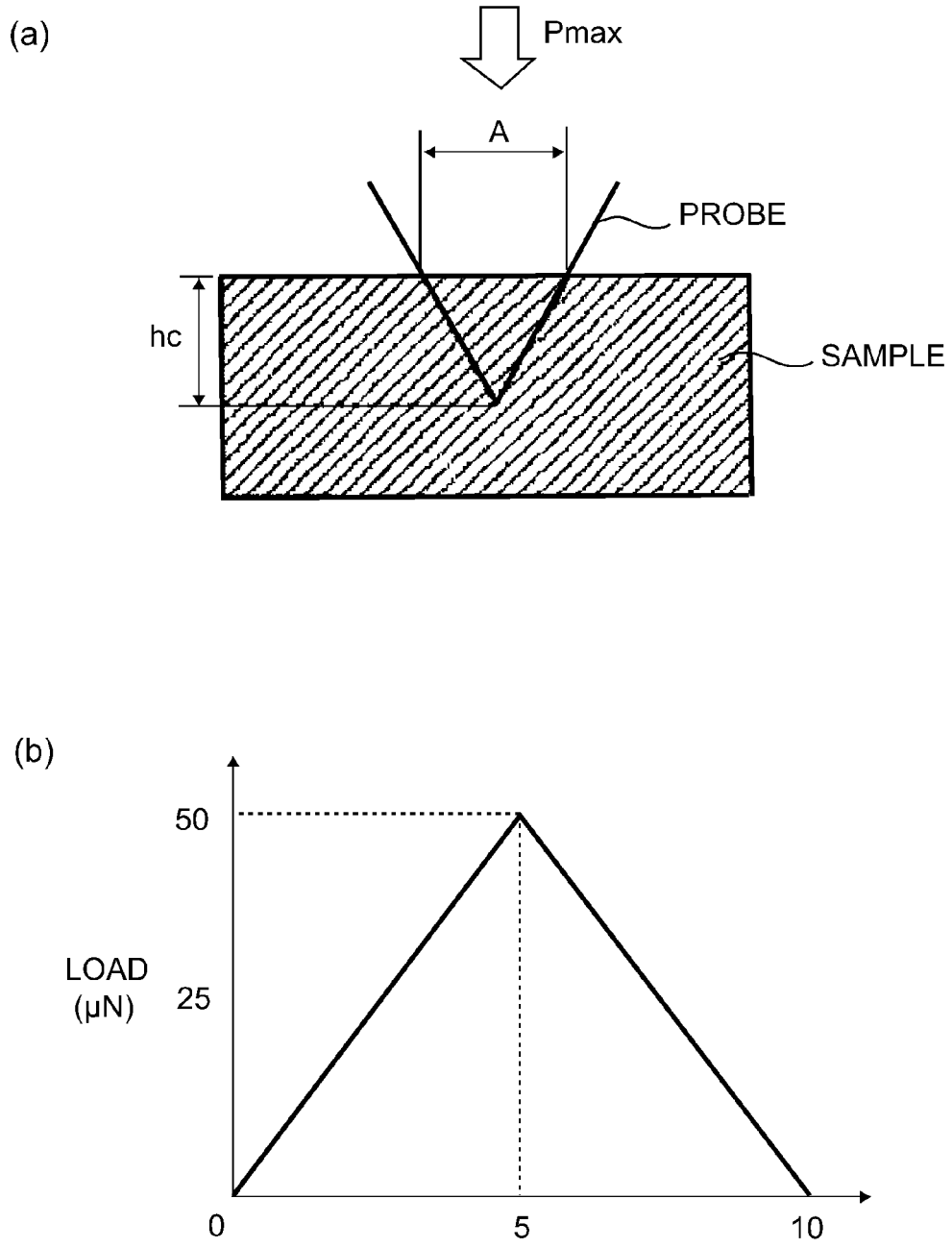
In FIG. 5, (a) and (b) are schematic views for illustrating measurement of minute hardness.

Here, for measurement of the minute hardness of the surface layer of the refreshing roller 51, a measuring device ("Tribo Scope", manufactured by Hysitron Corp.) as shown in (a) of FIG. 5 was used. As a measuring terminal for measuring the minute hardness, A Berkovich tip (142.3 degrees) was used. A load for the measurement was 50 μN. The load was increased to a designated load in 5 seconds, and then was eliminated in 5 seconds. In FIG. 5, (b) shows a load curve when the load for the measurement was 50 μN. A hardness H at this time is obtained in the following manner.

$$H=P\max/X$$

Here, Pmax is a maximum stress exerted on a probe, and A is a contact area of the probe. In the case of the probe used in this embodiment, the contact area A is $A=24.5\ hc^2$, where hc is a penetration depth (amount) through which the probe enters the refreshing roller. When the hardness H of the refreshing roller 51 was measured, the hardness H=0.07 GPa was obtained at the load of 50 μN.

When the load of the refreshing roller 51 exerted on the fixing roller 21 is P (N), the peripheral speed of the fixing roller 21 is V (mm/sec), the peripheral speed of the refreshing roller 51 is v (mm/sec), the minute hardness of the fixing roller 21 is H (GPa), and a half apex angle of the abrasive grain is θ (degrees), the following relationship may preferably be satisfied.

$$7\times10^{-3}\leq(P/\pi H\tan\theta)\times(|V-v|/V)\leq68\times10^{-3}$$

As a result, by the rubbing operation of the fixing roller 21 has the surface roughness Rz is 0.5 μm or more and 2.0 μm or less, and the recessed portions each of 10 mm or less in width by the abrasive grain are formed in an amount of 10 lines or more per 100 μm with respect to the rotational axis direction.

<Air Cleaning Member>

An air cleaning member (air blowing mechanism) 50 as a blowing mechanism for blowing the air onto the refreshing roller 51 to clean the surface of the refreshing roller 51 in order to maintain the surface roughness of the refreshing roller 51 will be described. In this embodiment, the air cleaning member 50 is an air duct (hollow pipe like member) provided with air nozzles (holes) 54 for blowing the air onto the refreshing roller 51.

Figure 6:
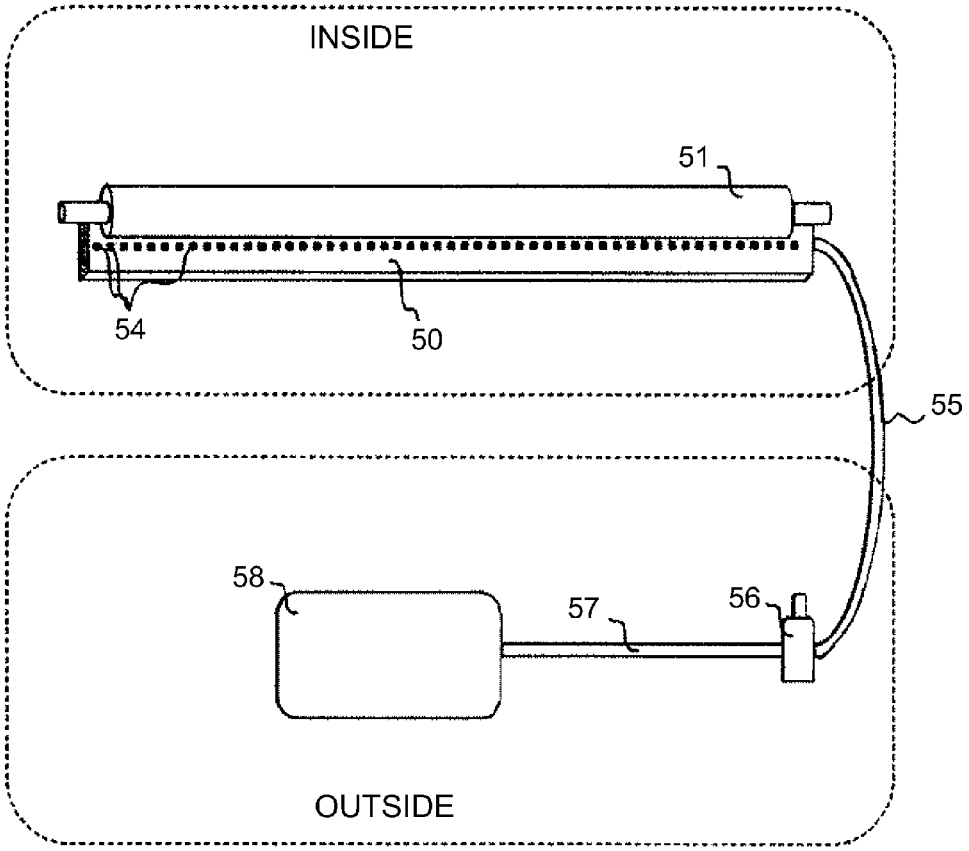
FIG. 6 is an illustration of an air cleaning mechanism.

This air cleaning member 50 has a length substantially corresponding to a length, and is provided with the air nozzles (holes) 54 as air blowing openings disposed in line along the longitudinal direction at predetermined (certain) intervals (FIG. 6). That is, the air cleaning member 50 is provided with the air nozzles as a plurality of openings.

The air cleaning member 50 is disposed in proximity and parallel to the refreshing roller 51 while opposing the refreshing roller 51, placed in the contact state with the fixing roller 21, in the air nozzle 54 side. From one end side of the air cleaning member 50, m high-pressure air is supplied into the hollow portion, so that the air is blown toward the refreshing roller 51 through the respective air nozzles 54 to perform air blowing onto the refreshing roller 51 in the entire length region. In FIG. 2, A represents a jet of the air issuing from the air cleaning member 50 toward the refreshing roller 51.

There is a need to supply the high-pressure air in order to perform the air blowing, the type of an air pump is no object if blowing pressure and operation can be satisfied. For example, the high-pressure air may also be supplied by using a concentrated air piping using a large-sized compressor or by using a nitrogen or air cylinder. In this embodiment, a constitution in which an air pump 58 and an electromagnetic valve 56 which are controlled by the control circuit portion 101 are combined, and as the air blowing openings, the air nozzles 54 perforated with holes as certain intervals are used to increase the air pressure was employed.

FIG. 6 is a communication system diagram between the air cleaning member 50 and the air pump 58. At first, the high-pressure air is generated by the air pump 58, and then is introduced from an air piping 57 into the electromagnetic valve 56. The electromagnetic valve 56 is a switch for effecting ON/OFF-control of the high-pressure air supplied from the air pump 58 to the air cleaning member 50, and is capable of effecting the ON/OFF-control of the jet of the air issued from the nozzles 54 of the air cleaning member 50.

Figure 7:
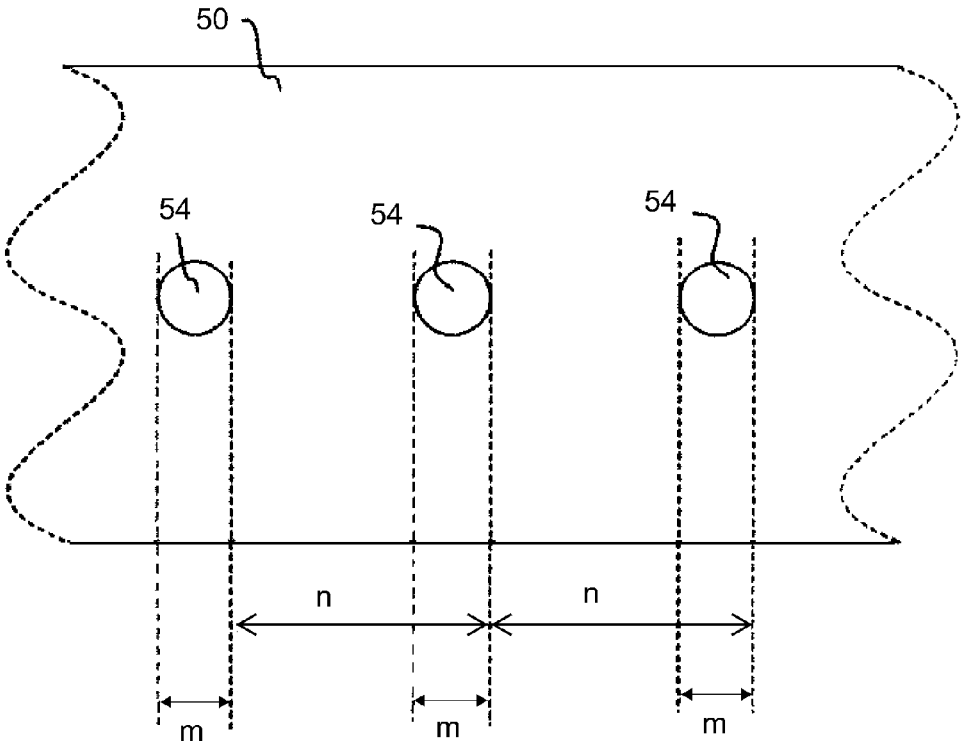
FIG. 7 is a partly enlarged view of a nozzle portion of an air cleaning member.

The air is introduced from the electromagnetic valve 56 into the fixing device 20 through air piping 55, so that the pressure is uniformly applied to the inside of the air cleaning member 50. Then, the air is jetted through the air nozzles 54. As shown in a schematic view of FIG. 7, a diameter m of the hole of each air nozzle 54 was set at 1 mm, and an interval n between holes was set at 5 mm. The air pump 58 was set so that the number of the air nozzles 54 disposed in line at uniform intervals over a longitudinal width (length) of 330 mm of the refreshing roller 51 is 67 and so that the air pressure at its peak is about 0.15 MPa.

Figure 8:
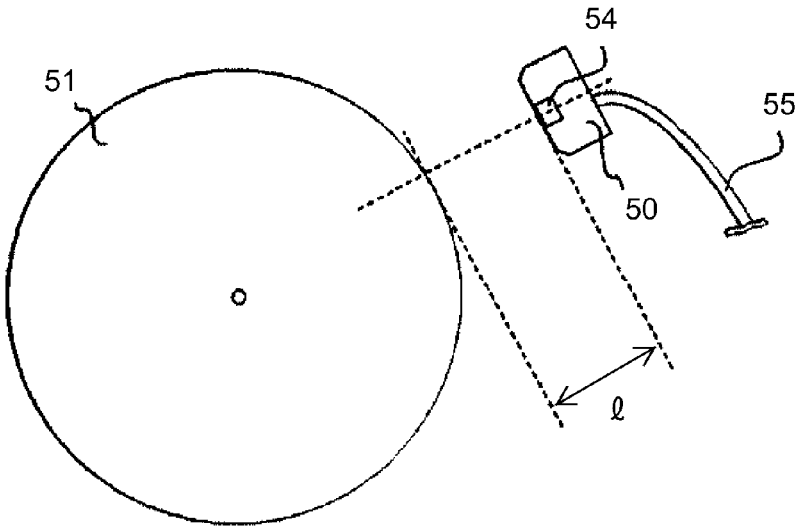
FIG. 8 is a schematic view showing a positional relationship between the refreshing roller and the air cleaning member.

A peak flow rate of the air pump 58 is about 400 l/m, and a stand-by pressure in a state immediately after the electromagnetic valve 56 is closed is about 0.3 MPa. When the number of the air nozzles 54 is large, the air nozzles 54 are capable of uniformly cleaning the refreshing roller 51 with respect to the longitudinal direction, but the peak pressure is decreased. In this case, countermeasures such that the original pressure of the air pump 58 is increased or that the number of the air nozzles 54 from which the air is jetted at once is decreased is taken. The air pressure was measured, based on a positional relationship between the diameter m and the interval (spacing) n shown in FIG. 7 and a gap 1 shown in FIG. 8, at a position where the position of the air nozzles 54 is remotest from the refreshing roller 51.

<Refusing Operation>

In the refreshing operation (surface modifying operation mode), in a state in which the fixing roller 21 is rotationally driven, the refreshing roller 51 is caused to perform the contacting operation by the contact and separation mechanism 53. As a result, the refreshing roller 51 is press-contacted to the fixing roller 21 to form the rubbing nip N51. Further, the refreshing roller 51 is rotationally driven with a peripheral speed difference relative to the fixing roller 21.

In this embodiment, the refreshing roller 51 is rotationally driven in the same direction as the fixing roller 21 at the rubbing nip N51 with the peripheral speed difference. Specifically, the peripheral speed of the fixing roller 21 is 100 mm/s, and the peripheral speed of the refreshing roller 51 is 400 mm/s. The surface of the fixing roller 21 is rubbed with the refreshing roller 51 with the peripheral speed difference of 300 mm/s, so that the surface of the fixing roller 21 is modified.

The refreshing roller 51 performs the surface modifying operation, so that the surface layer of the fixing roller 21 is abraded in a very small amount, and therefore the contaminant such as a debris of PFA, the residual toner or the paper powder is deposited between the abrasive grains 51A. For this reason, the roughness of the abrasive grains 51A is gradually lowered, so that power of the surface modifying operation by the refreshing roller 51 with respect to the fixing roller 21 is lowered.

Therefore, the surface roughness of the refreshing roller 51 is maintained by removing the contaminant between the abrasive grains by the air jetting (refreshing cleaning mode) from the air nozzles 54 of the air cleaning member 51 to the refreshing roller 51 as described above. For this reason, it is possible to maintain the power of the surface modification on the fixing roller 21.

Figure 9:
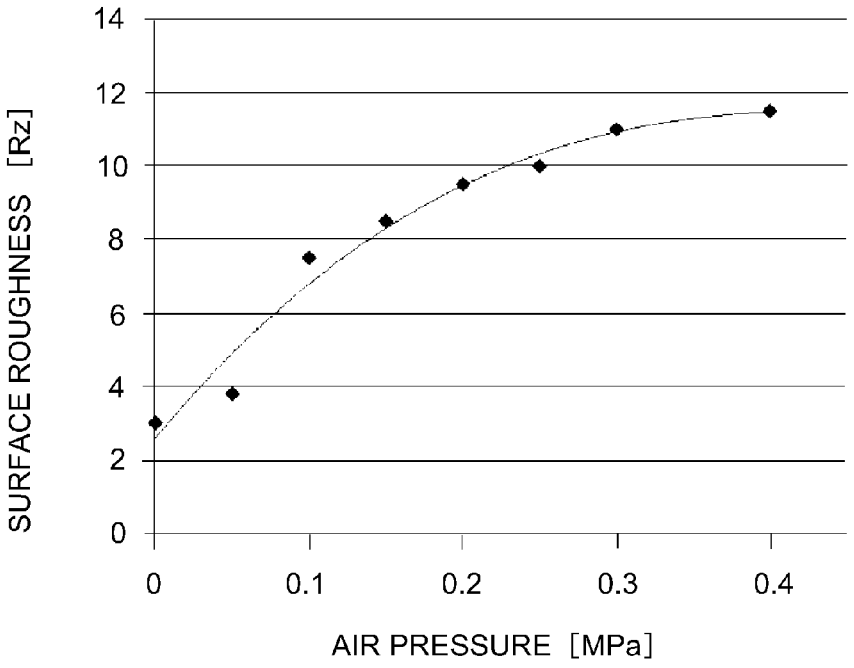
FIG. 9 is a graph showing a relationship between air cleaning pressure and cleaning power.

However, with respect to the cleaning power of the refreshing roller 51 by the air blowing, the contaminant clogged between the abrasive grains cannot be removed unless the air pressure to some extent is applied to the refreshing roller 51. In a result of a measurement during an experiment, as shown in FIG. 9, at the air pressure of 0.1 MPa or more, the cleaning power is achieved, so that the roughness of the abrasion, by the paper edge, generated at a paper edge-corresponding portion of fixing roller 21 was able to be eliminated. That is, a maximum of the air pressure applied to the refreshing roller 51 may preferably exceed 0.1 MPa. The surface roughness Rz necessary to achieve this effect was about 6-7 mm or more.

Figure 10:
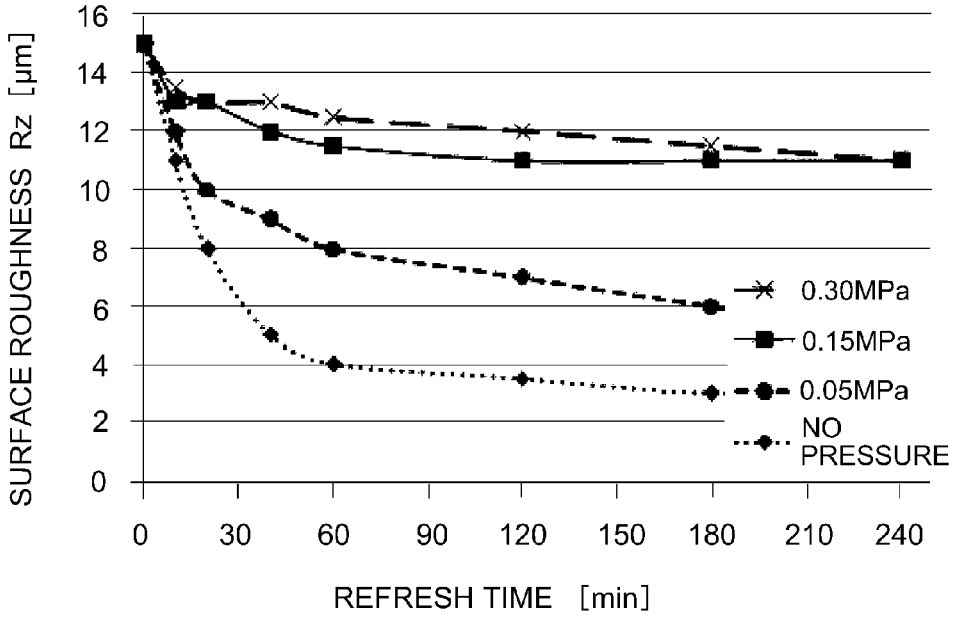
FIG. 10 is a graph showing a relationship between a refreshing time and the cleaning power at different pressures.

FIG. 10 is a plot of the surface roughness Rz for illustrating how progression of the surface roughness of the refreshing roller 51 changes when the air pressure is changed. In this test, in the case where the surface modifying operation is continuously performed on the fixing roller 21 while blowing the air at constant pressure, the progression of the surface roughness Rz of the refreshing roller 51 was measured. Also in this test, in order to maintain the surface roughness, of the refreshing roller 51, necessary to eliminate the abrasion of the fixing roller 21 by the paper edge under the indicated condition, it is understood that the air pressure is required to be 0.1 MPa or more.

Incidentally, during the printing, i.e., at timing when the recording paper P is present at the fixing nip N, in the case where the refreshing operation is performed, it would be considered that there is a risk such that the toner offset to the fixing roller surface layer is deposited on the surface layer 51*c* of the refreshing roller 51. For this reason, when the toner is gradually deposited on the refreshing roller 51, the toner has viscosity to the extent that it is difficult to perform the air cleaning, and therefore is clogged between the abrasive grains to lower the surface roughness in some cases.

For this reason, during the printing (image forming operation) of the image forming apparatus, the refreshing roller 51 may desirably be spaced (separated) from the fixing roller 51. That is, at the timing when the recording paper P is present at the nip N, it is desirable that the operations in the surface modifying operation mode and the refreshing cleaning mode are not performed.

In this embodiment, the refreshing operation with respect to the fixing roller 21 is executed at the time of an end of a print job, i.e., when a cumulative count of the number of sheets of the recording paper passed through the nip N (print number) is a predetermined number or more. Further, during the refreshing operation, the air cleaning for the refreshing roller 51 was concurrently performed. That is, the control circuit portion 101 execute the rubbing of the fixing roller 21 with the refreshing roller 51 and the cleaning of the refreshing roller 51 by the air cleaning member 51 in parallel.

This is because as described above, the abrasion (damage) by the paper edge is the problem generated by the continuous attack on the surface layer of the fixing roller 21 by the paper edge portions of the plurality of the recording papers (sheets). When the recording papers are of the same type, a glossiness difference of the image exceeds an allowable level when the print number exceeds a certain number. For that reason, at the time of the end of the print job, the cumulative count of the print number is discriminated, and in the case where the count exceeds a threshold, i.e., 500 counts in this embodiment, the refreshing operation is started.

Figure 11:
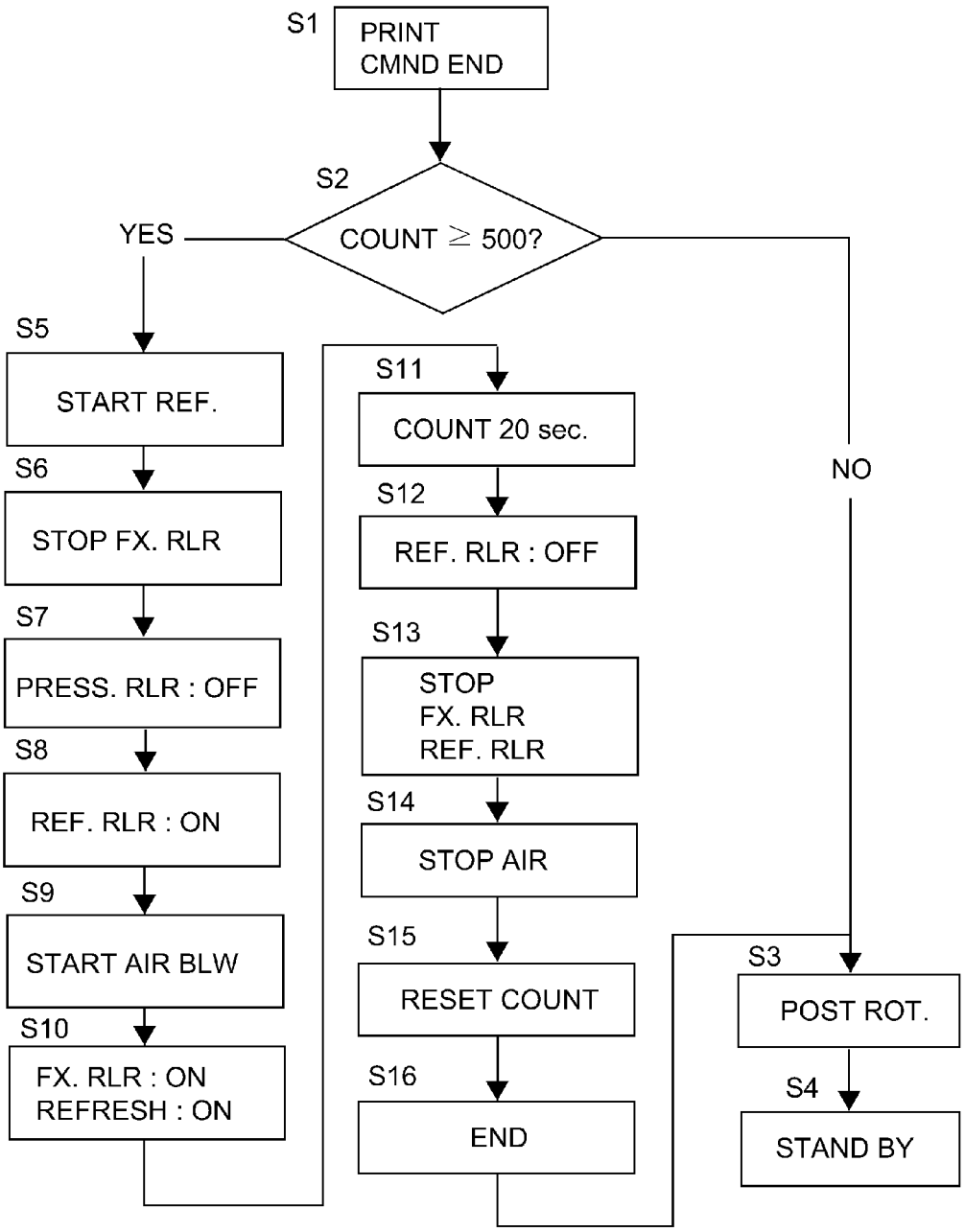
FIG. 11 is a flowchart of an operation during air cleaning.

Description will be made along a control flowchart of FIG. 11. The control circuit portion (controller) 101 discriminates, every time of the end of the print job (S1), whether or not the cumulative count of the print number is 500 sheets or more (S2). In the case where the count is less than 500 sheets, the controller 101 causes the image forming apparatus 100 to execute an ordinary operation (post-rotation operation) for the time of the end of the print job (S3), and then stops the operation of the image forming apparatus 100 to place the image forming apparatus 100 in a stand-by state (S4) until a subsequent print job signal is inputted. With respect to the fixing device 20, the controller stops the roller drive and performs the spacing operation of the pressing roller 22, and then the sequence goes to stand-by temperature control of the rollers 21 and 22.

In the case where the count is 500 (sheets) or more, the refreshing is started (S5). First, the drive of the fixing roller 21 is stopped (S6), and the pressing roller 22 is spaced (separated) from the fixing roller 21 (S7). Then, the contacting operation of the refreshing roller 51 with the fixing roller 21 is performed (S8), and then air jetting from the air nozzles 54 of the air cleaning member 50 is started (S9). Then, the drive of the fixing roller 21 and the drive of the refreshing roller 51 are started (S10).

As a result, the operations in the surface modifying operation mode with respect to the fixing roller 21 and the refreshing cleaning mode with respect to the refreshing roller 51 are concurrently executed. That is, the controller 101 executes the rubbing of the fixing roller 21 by the refreshing roller 51 and the cleaning of the refreshing roller 51 by the air cleaning member 50 in parallel.

After the refreshing for 20 seconds (S11), operations are performed in the order of the spacing operation for spacing the refreshing roller 51 (S12), stop of the drive of the fixing roller 21 and the refreshing roller 51 (S13) and stop of the air jetting (S14), so that the refreshing operation is stopped. Then, the print number count is cleared (S15), so that the refreshing operation is ended (S16). Thereafter, the ordinary print ending operation (post-rotation operation) of the image forming apparatus 100 is executed (S3), and then the operation of the image forming apparatus 100 is stopped and is placed in the stand-by state (S4) until the subsequent print job signal is inputted, with respect to the fixing device 20, the sequence goes to the stand-by temperature control of the rollers 21 and 22.

Figure 12:
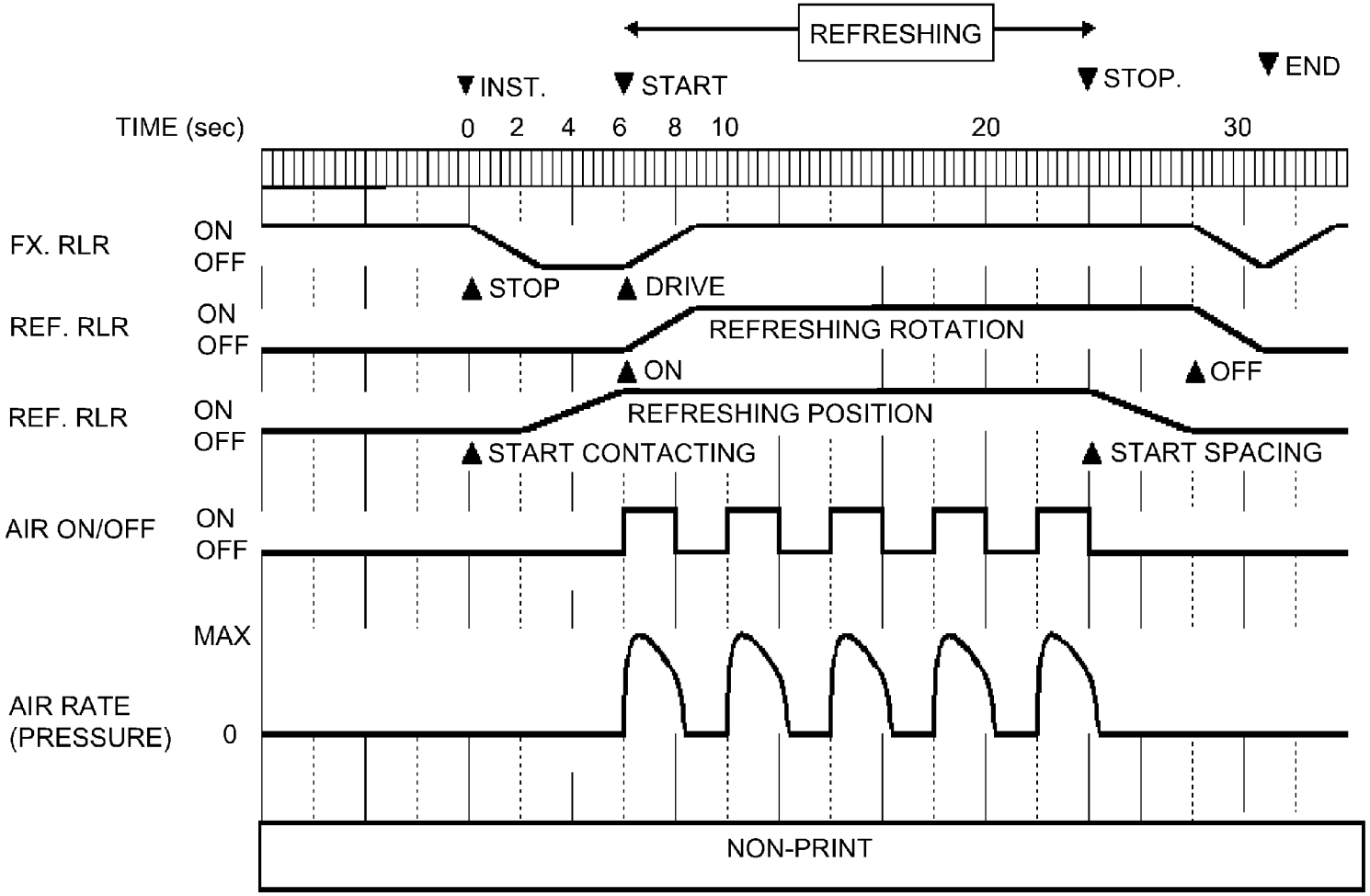
FIG. 12 is a timing chart of the operation during the air cleaning.

Further, in order to solve a problem such that the pressure is lowered, based on a characteristic of the air pump 58 used, when the air is continuously blown, the air blowing operation is intermittently performed, so that the air can be jetted (blown) at high pressure. The intermittent air blowing operation is controlled by ON and OFF of the electromagnetic valve 56. In this embodiment, the air blowing operation was, as shown in a timing chart of FIG. 12, performed in a repeated cycle of the blowing for about 2 sec and stop (of the blowing) for about 2 sec.

That is, the air cleaning member (air blowing mechanism) 50 is characterized in that the air is intermittently n on the refreshing roller 51 during the execution of the operation in the refreshing cleaning mode.

Table 1 is comparison table of effects of Embodiment 1 ("EMB. 1") and various Comparison Examples ("C.E.") including a conventional example. As the recording paper P, Hammermill LTR-sized paper (75 gsm, manufactured by International Paper) was used. SHeets of this recording paper P were subjected to continuous sheet passing through the fixing device, and thereafter high-gloss recording paper (e.g., "OK topcoat", 157 gsm, size: 330×483 mm (13×19 inch) on which a monochromatic image of black was formed was passed through the fixing device at each point of times of recording paper print numbers. At that time, an image level of glossy band (abrasion by paper edge) in width of the LTR-sized paper was evaluated by eye observation. This level was evaluated according to the following index based on three levels.

○: Level at which the glossy band is almost unrecognizable at a solid black portion.

Δ: Level at which the glossy band is recognizable when attention is paid, but is of no problem when the image is a natural image.

x: Level at which the glossy band is recognizable on the image.

TABLE 1

| | | ALBPE*$_2$ (×$10^3$ SHEETS) | | | | | |
|---|---|---|---|---|---|---|---|
| | CM*$_1$ | Initial | 2 | 5 | 10 | 50 | 100 |
| EMB. 1 | A.C. | ○ | ○ | ○ | ○ | ○ | ○ |
| C.E. 1 | R.R. | ○ | ○ | ○ | ○ | Δ | x |
| C.E. 2 | B | ○ | ○ | ○ | x | x | x |
| C.E. 3 | P.C. | ○ | ○ | ○ | ○ | ○ | ○ |
| C.E. 4 | No | ○ | ○ | Δ | x | x | x |

*$_1$"CM" represents a cleaning method. "A.C." is the air cleaning. "R.R." is a rubber roller. "B" is a brush. "P.C." is a periodical cleaning. "No" is no cleaning method (means).
*$_2$"ALBPE" represents an abrasion (damage) level by the paper edge.

Embodiment 1

There was no generation of the abrasion by the paper edge even after the paper passing of 1000×$10^3$ sheets.

Comparison Example 1

A cleaning roller including, as the elastic layer, a 1 mm-thick silicone rubber layer formed as the surface layer of the cleaning roller (core metal) formed of SUS (stainless steel) in an outer diameter of 8 mm as described in JP-A 2008-40365 is used. The case where the cleaning roller is contacted to the refreshing roller and is disposed so as to be rotatably by the rotation of the refreshing roller was used as Comparison Example 1. Until the print number was less than 100×$10_3$ sheets, the image level was good, but when the print number is 100×$10^3$ sheets or more, the contaminant was not completely removed from the refreshing roller and thus the abrasion by the paper edge was generated. Incidentally, every 100×$10^3$ sheets, by performing periodical cleaning of the refreshing roller and the cleaning roller, a good image was able to be obtained until the print number is 1000×$10^3$ sheets.

Comparison Example 2

A cleaning roller including heat-resistant fibers each having a thickness of about 100 μm was disposed so that free ends the fibers were contacted to the refreshing roller 51 at a density of about 5 fibers/1 mm. When the print number exceeded about $50\times10^3$ sheets, abrasion or drop of the abrasive grains was generated at the surface layer 51*c* of the refreshing roller 51, so that uneven roughness on the fixing roller was generated.

Comparison Example 3

A periodical cleaning was carried out every $5\times10^3$ sheets. In the cleaning, an operation for wiping off the surface contaminant with a nonwoven fabric impregnated with ethanol was repeatedly performed. The surface roughness of the refreshing roller is returned to the original surface roughness when the cleaning is carried out, and therefore also the effect of the fixing roller surface modifying operation is maintained, so that a good image was obtained. However, in this case, there is a need to perform cleaning maintenance by interrupting the print job every $5\times10^3$ sheets, and therefore Embodiment 1 is superior to Comparison Example 3.

Comparison Example 4

The case where the cleaning member is not used was used as Comparison Example 4. The abrasion by the paper edge was conspicuous when the print number was about $5\times10^3$ sheets, and resulted in image damage when the print number was about $100\times10^3$ sheets.

As described above during the fixing roller surface modifying operation, the refreshing roller surface layer is cleaned by applying air pressure to thereto, so that the surface roughness of the refreshing roller surface layer can be kept at a high level, and thus a maintenance interval was able to be shortened while maintaining the image quality. That is, by providing a non-contact air cleaning mechanism, it is possible to realize a maintenance-free constitution with no deposition of the contaminant. Further, the surface property of the fixing member is maintained, so that improvement inequality of a resultant product can be expected and it becomes possible to perform a stable continuous printing operation.

Embodiment 2

In Embodiment 1 described above, during the refreshing operation, the air cleaning operation of the refreshing roller 51 was concurrently performed. The air cleaning operation is not limited thereto, but may also be carried out during the stand-by operation or the printing operation when the air is capable of jetted (blown) onto the surface of the refreshing roller 51 with no interrelation of the drive of the refreshing roller 51 with the drive of the fixing roller 21.

A durability test under a condition such that a paper passing job of $1\times10^3$ sheets in average was continuously repeated was conducted, and at that time, an effect was measured. In this case, after the end of each of the jobs, air jetting (blowing) for 60 sec was uniformly carried out. Even with respect to the refreshing roller 51 on which the contaminant was clogged between the abrasive grains by several-time refreshing operation, by performing the air jetting, the recovery of the surface roughness of the surface layer 51*c* was achieved similarly as in Embodiment 1, and eliminating power of the abrasion of the fixing roller 21 by the paper edge was maintained even in the paper passing of $1000\times10^3$ sheets, so that the effect was obtained.

In this case, the driving speed of the refreshing roller 51 is no object, but the refreshing roller 51 may desirably be rotated during the air cleaning. For example, a constitution in which the air is jetted at a position where the air blowing direction is deviated from the center shaft of the refreshing roller 51, and thus the refreshing roller 51 is rotated by the air pressure may also be employed.

Embodiment 3

Figure 13:
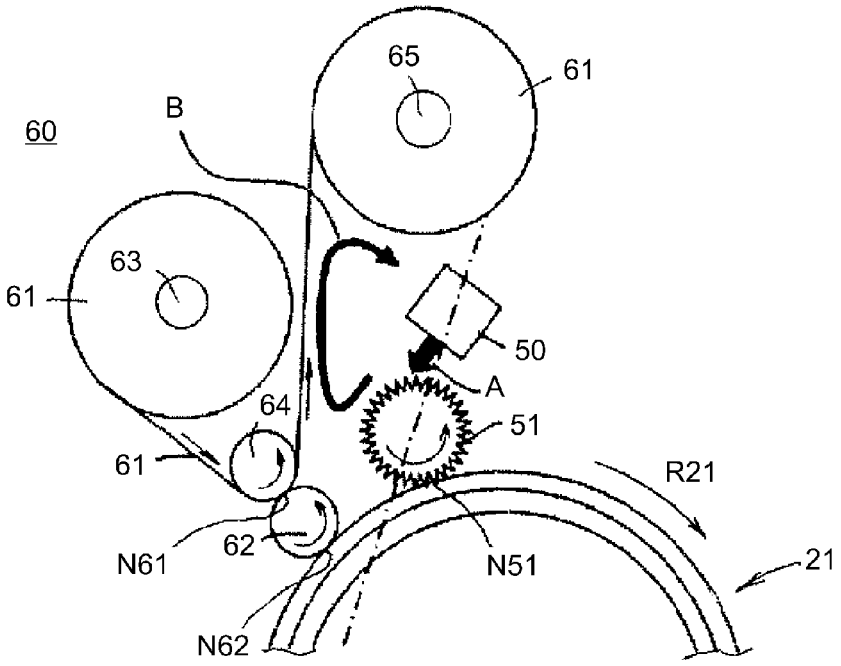
FIGS. 13 and 14 are schematic views of a principal part of a fixing device in Embodiment 3.

A fixing device in Embodiment 3 is provided with, in addition to the fixing device 20 as in Embodiment 1 or 2, a cleaning mechanism 60 for cleaning the fixing roller 21 in contact with the fixing roller 21 as shown in FIG. 13. Constituent members or portions common to the fixing devices 20 in Embodiments 1 to 3 are represented by the same reference numerals or symbols and will be omitted from redundant description.

The cleaning mechanism 60 for the fixing roller 21 in this embodiment includes a collecting roller (rotatable collecting member) 62, formed of SUS 304 in a diameter of 20 mm, for collecting the contaminant with the fixing roller 21. The collecting roller 62 is provided close to the refreshing roller 51 in an upstream side of the refreshing roller 51 with respect to a rotational direction of the fixing roller 21, and is rotated in the same direction as the rotational direction of the fixing roller 21. The collecting roller 62 collects, in the case where the toner is scraped off from the recording paper at the fixing nip N and is offset to the fixing roller 21, the offset toner on the surface thereof at a contact position N62 with the fixing roller 21.

To the surface of the collecting roller 62, a cleaning web (sheet-like cleaning sheet) 61 formed of a nonwoven fabric is contacted and wipes off the toner, deposited on the collecting roller, at a contact position N61. The web 61 is fed little by little continuously or intermittently from a feeding shaft 63 side toward a winding-up shaft 65 side via a pressing roller 64. The web 61 is press-contacted to the collecting roller 62 at a predetermined pressing force by the pressing roller 64 to wipe off the toner (the contaminant on the surface of the rotatable collecting member) deposited on the collecting roller 62. That is, the web 61 cleans the collecting roller 62.

The web 61 is set so that a portion (cleaning surface) thereof contacting the collecting roller 62 is refreshed by being fed by a predetermined amount and then the refreshed cleaning surface contacts the collecting roller 62 before being saturated with the toner. The constitution of the refreshing roller 51, the contact and separation mechanism 52 (not shown in FIG. 13) between the refreshing roller 51 and the fixing roller 21, the constitution of the air cleaning member 50, the control of the refreshing operation and the air cleaning, and the like are similar to those in the fixing device 20 in Embodiments 1 and 2.

In this embodiment, a constitution in which a direction of air A blowing from the air nozzles 54 of the air cleaning member 50 toward the refreshing roller 51 is tilted, toward a direction directed toward the cleaning mechanism 60, from a direction directed toward the center (rotation center) of the refreshing roller 51.

Also in the case of this embodiment, similarly as in the case of the fixing device 20, at first, the high-pressure air is generated by the air pump 58 (FIG. 6), and then is introduced from the air piping 57 into the electromagnetic valve 56. The electromagnetic valve 56 is a switch for effecting ON/OFF-control of the air supplied from the air pump 58, and is capable of effecting the ON/OFF-control of the air issued from the nozzles 54. The air is introduced from the electromagnetic valve 56 into the fixing device 20 through air piping 55, so that the pressure is uniformly applied to the inside of the air cleaning member 50. Then, the air is jetted through the air nozzles 54 perforated with a plurality of holes.

A diameter m of the hole of each air nozzle 54 was set at 1 mm, and an interval n between holes was set at 5 mm. The air pump 58 is set so that the number of the air nozzles 54 disposed in line at uniform intervals over a longitudinal width (length) of 330 mm of the refreshing roller 51 is 67 and so that the air pressure of the air pump 58 is 0.15 MPa, whereby when the electromagnetic valve 56 is closed, an interval pressure of the piping 57 is 0.15 MPa. At the time when the internal pressure of the piping 57 reaches 0.15 MPa, the electromagnetic valve 56 is opened. The high-pressure air passes through the piping 55 to reach the air cleaning member 50, and then is blown through the air nozzles 54.

At this time, the pressure of the air blown onto the surface of the refreshing roller 51 through one air nozzle is 5 kPa. The piping 55 is increased in temperature to a high temperature of about 150° C., and therefore uses a pipe formed of a heat-resistant fluorine-containing rubber in an inner diameter of 8 mm and a length of 800 mm. The piping 57 is used at normal temperature, and therefore uses a pipe formed of a urethane resin in an inner diameter of 8 mm and a length of 1500 mm. The gap 1 between the refreshing roller 51 and the openings of the air nozzles 54 is 3 mm, and also the air pressure measurement is carried out in a state in which the gap of 3 mm is provided.

Figure 14:
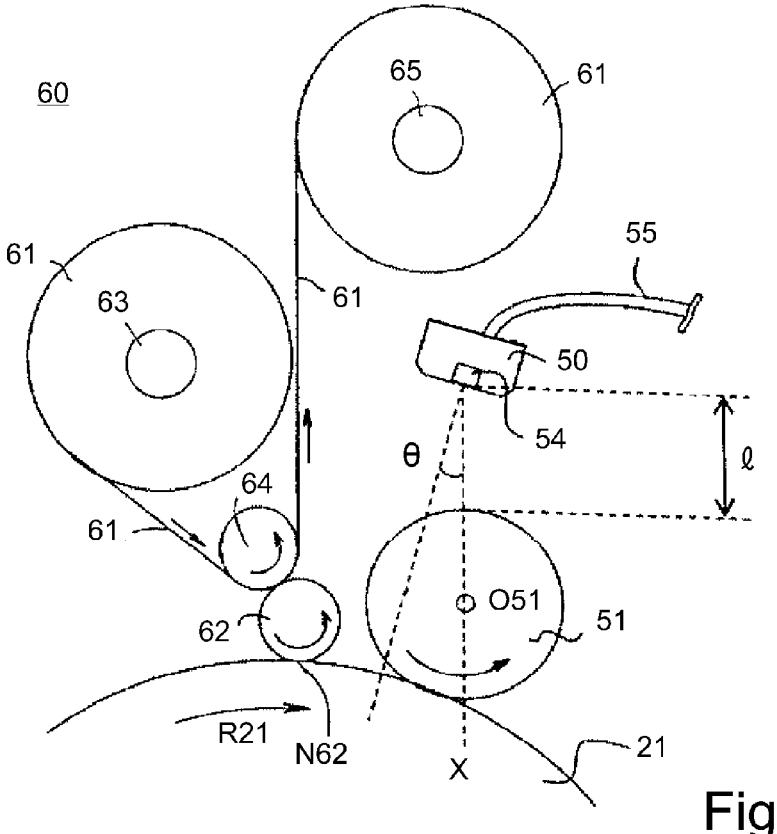

The air blowing direction has, as shown in FIGS. 13 and 14, an angle θ of 30 degrees from the direction directed toward the center (rotation center), and is tilted toward the direction of the web 61 of the cleaning mechanism 60. Further, the web 61 is located downwind of a rectilinear line X connecting the openings of the air nozzles 54 with a center O51 of the refreshing roller 51 and is disposed to oppose the air nozzles. As a result, a flow B of the air can be performed so as to be moved along the surfaces of the collecting roller 62 and the web 61.

By the refreshing air cleaning, the surface of the refreshing roller 51 is cleaned, but the PFA debris deposited on the surface of the refreshing roller 51 is blown away. The PFA debris has a higher specific gravity than the air, and therefore is liable to concentrate at an outside of the flow B by the centrifugal force, so that the PFA debris is liable to deposit on the web 61 and the collecting roller 62. Further, the web surface on which the contaminant such as the PFA debris is deposited is located downstream of the collecting roller 62.

That is, the air blowing surface of the web 61 on which the air is blown through the air nozzles 54 is constituted so as to be located in the downstream side of the web feeding direction. That is, the surface of the web 61 on which the air B blown from the air cleaning member 50 is downstream, with respect to the feeding direction of the web 61, of the contact position N61 between the web 61 and the refreshing roller 51. Accordingly, the air blowing surface of the web 61 does not adversely affect the collecting power of the offset toner.

In this way, a constitution in which the air blowing direction is somewhat deviated from the center of the refreshing roller 61 to blow the air from an oblique direction toward the collecting roller 62 and the web 61, and thus the PFA debris blown away from the refreshing roller 51 is collected by the web 61 is employed. As a result, it is possible to suppress scattering of the PFA debris, blown away by the cleaning, over the inside of the fixing device to alleviate the image defect due to the contaminant. Further, also the abrasion of the fixing roller 21 by the deposition of the contaminant can be alleviated, so that the surface property of the fixing roller 21 can be maintained for a long term and thus lifetime extension of the fixing roller 21 can be realized.

Next, a weight of the PFA debris deposited on the web 61 when the air blowing angle θ was changed was measured. As a measuring condition, the pressure of the air pump 58 was set at 0.15 MPa, the contact temperature of the fixing roller 21 was set at 170° C., the peripheral speed of the fixing roller 21 was set at 100 mm/s, the peripheral speed of the refreshing roller 51 was set at 400 mm/s, and a continuous operation time was set at 3 hours.

Figure 15:
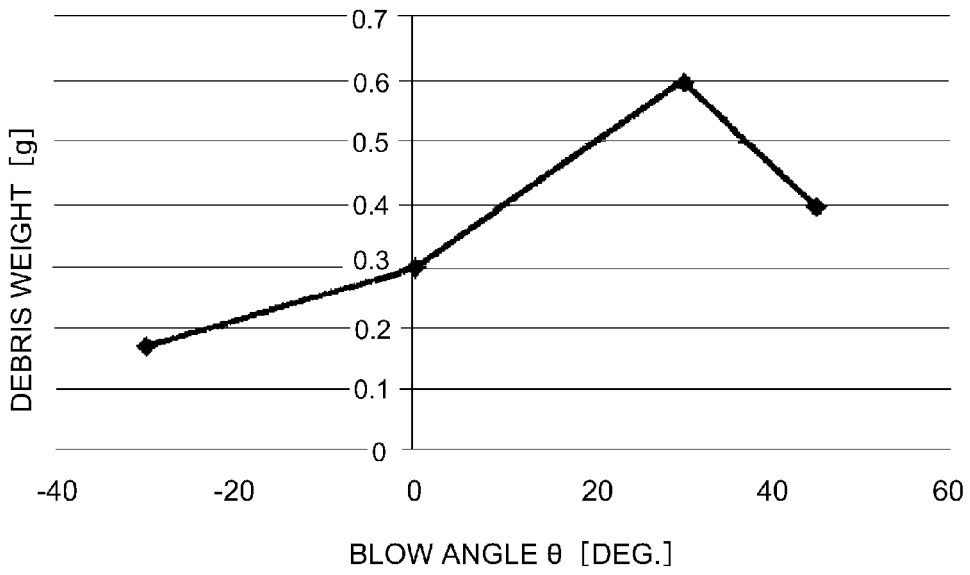
In FIG. 15, (a) is a graph showing a relationship between a blowing angle and a weight of PFA debris deposited on a web, and (b) is a graph showing a relationship between the blowing angle and a surface roughness of the refreshing roller.
Figure 15:
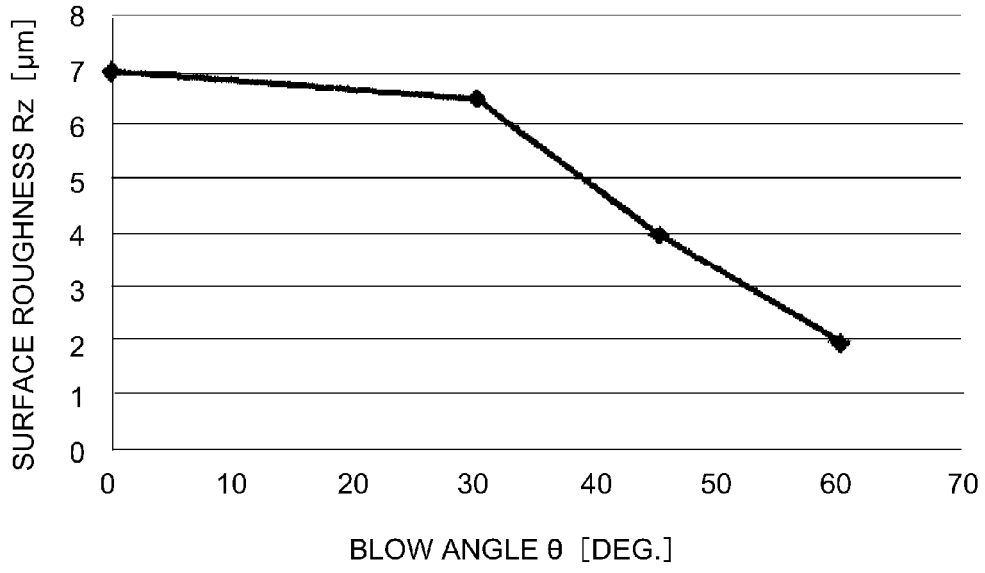

A result at that time is shown in (a) of FIG. 15. It is understood that the weight of the PFA debris deposited on the fixing roller 21 is increased with a degree of the tilt of the air blowing direction of the air nozzles 54 toward the web 61. However, when the degree of the tilt is excessively large, the pressure of the air applied to the refreshing roller surface is lowered, so that the air cleaning power is lowered.

In FIG. 15, (b) shows a relationship between blowing air θ and the refreshing roller surface roughness Rz. When the angle θ is increased, the surface roughness Ra of the refreshing roller 51 is lowered. As a result, it is understood that the contaminant such as the PFA debris is deposited on the surface of the refreshing roller 51. That is, when the angle θ is large, the cleaning power is lowered.

Therefore, in this embodiment, an optimum value of the angle θ at which the contaminant such as the PFA debris can be efficiently collected by the web 61 is about 30 degrees. Further, in the case where the air blowing direction is tilted in an opposite direction, a collecting weight (amount) by the web 61 is lowered, so that most of the PFA debris is deposited on other components located inside the fixing device 20 to damage the fixing roller 21, thus resulting in the image defect.

Therefore, by tilting the air blowing direction, from the air nozzles 54, toward the direction in which the web 61 is disposed, the PFA debris blown away from the refreshing roller 51 can be collected by the web 61, so that it is possible to suppress the scattering of the PFA debris, blown away by the cleaning, over the inside of the fixing device 20. As a result, it is possible to alleviate the degree of the image defect due to the contaminant.

Figure 16:
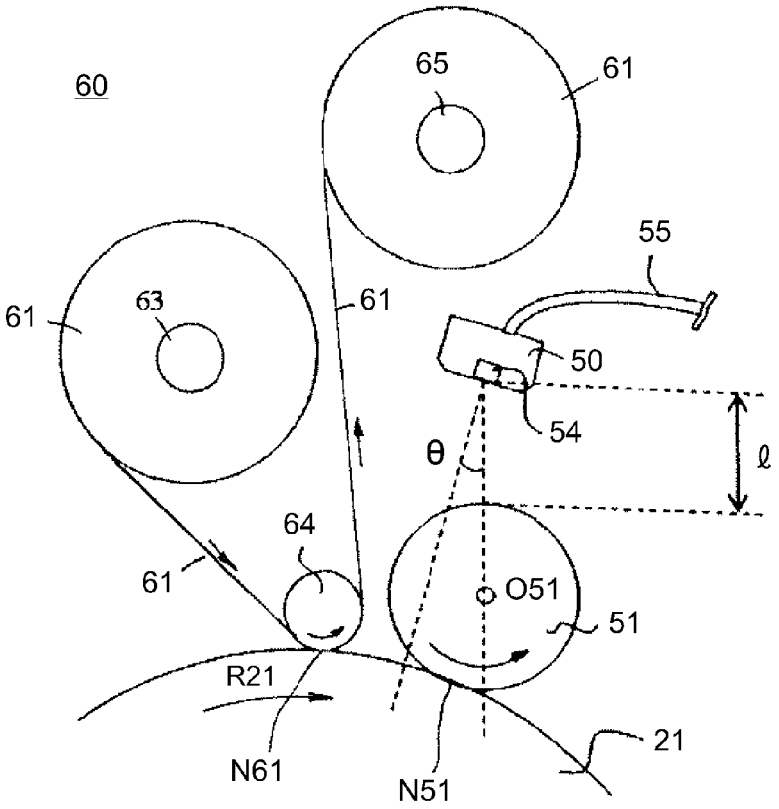
FIG. 16 is a schematic view of a principal part, in another constitution, of the fixing device in Embodiment 3.

The cleaning mechanism 60 can also have a constitution, as shown in FIG. 16, in which the collecting roller 62 is omitted and the web 61 is directly contacted to the surface of the fixing roller 21 at a predetermined pressing force by the pressing roller 64 to clean the surface of the fixing roller 21. Also in this case, the feeding constitution of the web 61, the constitution of a position relationship of the web 61 with the refreshing roller 51 and the air cleaning member 50, and the like are the same as those in FIGS. 13 and 14, so that a similar effect can be achieved.

Embodiment 4

Figure 17:
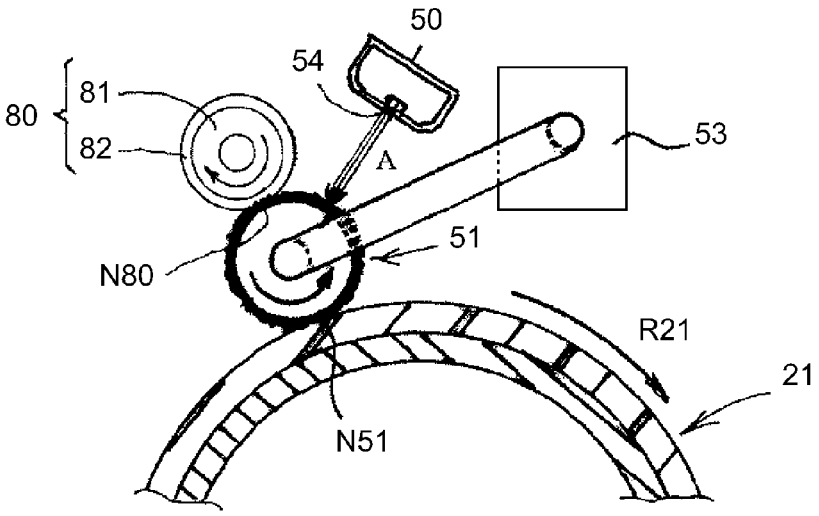
FIG. 17 is a schematic view of a principal part of a fixing device in Embodiment 4.

In the constitutions of the fixing devices in Embodiments 1 and 2, further as shown in FIG. 17, it is also possible to employ a fixing device constitution provided with a cleaning roller 80 as a cleaning member for cleaning the refreshing roller 51 in contact with the refreshing roller 51.

The cleaning roller 80 is formed by providing an elastic layer 82 on a metal core shaft (base layer) 81. In this embodiment, the cleaning roller 80 is a roller including a silicone rubber layer as the elastic layer 82 formed as the surface layer of a roller (core metal) 81 of SUS (stainless steel).

The cleaning roller 80 is rotatably supported by a supporting member (not shown) provided at each of longitudinal (rotational axis direction) end portions of the core metal 81. Further, the cleaning roller 80 is pressed against the refreshing roller 51 at a predetermined pressure by urging the supporting member, provided at each of the longitudinal end portions of the cleaning roller 80, by a pressing spring (not shown) as an urging member. As a result, between the refreshing roller 51 and the cleaning roller 80, a nip N80 having a predetermined width with respect to respective surface movement directions is formed.

In this embodiment, the cleaning roller 80 is pressed against the refreshing roller 51 at a total pressure of 5N and is rotated by rotation of the refreshing roller 51. However, the cleaning roller 80 is not limited thereto, but may also be driven by a particular driving means. Further, depending on the case, the cleaning roller 80 may have a peripheral speed difference with the refreshing roller 51, and may also be rotated so that the surface movement directions of the cleaning roller 80 and the refreshing roller 51 are either of the same direction and opposite directions at a contact portion (cleaning portion) with the refreshing roller 51.

Further, in this embodiment, the cleaning roller 80 and the refreshing roller 51 are mounted in the same unit. Accordingly, in the case where the refreshing roller 51 is pressed against the fixing roller 21, also the cleaning roller 80 moves in synchronism with the refreshing roller 51, and therefore the refreshing roller 51 and the cleaning roller 80 are always pressed.

Further, the cleaning roller 80 has a low pressure and is not provided with a driving means, and therefore can have a simply detachable constitution. In the case where the refreshing roller 51 is contaminated, by exchanging the refreshing roller 51 after the contaminant of the refreshing roller 51 is accumulated on the cleaning roller 80, rather than by simply exchanging the refreshing roller 51, a maintenance property is excellent and also a running cost is suppressed. In this embodiment, the refreshing roller 51 is subjected to non-contact air jet cleaning by the air cleaning member 50, and therefore the cleaning roller 80 stand long use. Accordingly, a maintenance interval of the cleaning roller 80 can be remarkably reduced.

In this embodiment, an affinity for the toner is increased in the order of (fixing roller surface layer)<(refreshing roller surface layer)<(collecting roller surface layer). That is, the affinity for the toner of the refreshing roller 51 is higher than the affinity for the toner of the fixing roller 21, and the affinity for the toner of the cleaning roller 80 is higher than the affinity for the toner of the refreshing roller 51.

The surface layer of the refreshing roller 51 is formed with a PFA tube excellent in parting property, and the surface roughness of the refreshing roller 51 is larger than the surface roughness of the fixing roller 21, and therefore the toner is liable to be deposited on the surface of the refreshing roller 51 more than the surface of the fixing roller 21. Further, by using the silicone rubber at the surface layer of the cleaning roller 80, the surface of the cleaning roller 80 can have a higher affinity for the toner than the surface of the refreshing roller 51, so that the toner is more liable to be deposited on the cleaning roller 80 than the refreshing roller 51.

Accordingly, even when the toner offset to the fixing roller 21 is deposited on the refreshing roller 51, this toner is transferred from the surface of the refreshing roller 51 onto the surface of the cleaning roller 80. For this reason, on the surface of the refreshing roller 51, the toner is not readily melted (fused). That is, even when the toner is deposited on the surface of the refreshing roller 51, this toner is transferred onto and deposited on the cleaning roller 80. For that reason, such phenomena that the toner deposited on the surface of the refreshing roller 51 adheres to the surface of the refreshing roller 51 by thermal denaturation and that the toner is mixed with the contaminant such as the paper powder to generate agglomerate are suppressed.

Accordingly, such phenomena that by the deposition of the contamination (contaminant) such as the toner, the abrasion (damage) is generated on the surface layer of the fixing roller 21 and that the surface state of the fixing roller 21 cannot be placed in a desired state can be suppressed.

In order to compare the affinity for the toner between the surface layers, in a state in which the temperature of the fixing roller 21 is 160° C. as a control temperature, the toner is forcedly offset. Then, after the offset toner passes through the nip between the two rollers 51 and 80, whether the toner is deposited on which roller of these two rollers is observed.

In this embodiment, most of the toner offset to the surface of the fixing roller 21 was, after passed through the nip N51 with the refreshing roller 51, deposited on the refreshing roller 51. Further, most of the toner deposited on the surface of the refreshing roller 51, after passed through the nip N80 with the cleaning roller 80, deposited on the cleaning roller 80.

In this way, by depositing (melting) the toner, deposited on the surface of the refreshing roller 51, on the cleaning roller 80, it is possible to maintain, for a long term, power of the refreshing roller 51 for modifying the surface state of the fixing roller 21. Further, by employing a constitution in which the cleaning roller 80 is made detachably mountable to the fixing device 20 relatively simply, the maintenance property is excellent and also the running cost is suppressed.

In this embodiment, the surface layer of the cleaning roller 80 was the elastic layer formed with the silicone rubber. For example, as in this embodiment, in order to carry out contact cleaning of the refreshing roller 51 provided at the surface thereof with the abrasive grains as a modifying member, as another member, a heat-resistant elastic member such as fluorine-containing rubber can suitably be used. Also use of a constitution in which the air is also blown onto the cleaning roller 80 is effective.

Also the fixing device 20 in Embodiment 3, as in this embodiment (Embodiment 4), can employ a device constitution in which the refreshing roller 51 is provided with the cleaning roller 80, and a similar effect can be obtained.

Embodiment 5

In the description unit Embodiment 4, as the refreshing roller 51 which is the rotatable rubbing member, the constitution including the rubbing material 51A was described. However, when a constitution in which the above-described minute abrasion) of the fixing roller (fixing member) 21 is allowable is employed, a rotatable rubbing member in the form such that a surface layer of a roller of, e.g., SUS or Al is roughened by being subjected to blasting or by forming recessed-shaped holes or grooves may also be used.

As an example of the constitution in which the minute abrasion is allowable, it would be considered that a constitution in which a second fixing device (second image heating apparatus) is provided downstream of the fixing device and the case where an apparatus for performing coating or laminating of a surface of a resultant product is provided downstream of the fixing device are employed. This is because the abrasion generated on the image during first fixing can be made in conspicuous showing second fixing (image heating) or image surface treatment.

In this case, the pressure of the refreshing roller 51 applied to the fixing roller 21 may preferably be low, and is set at pressure of 20 g/cm or more and 70 g/cm. Further, the surface roughness Rz of the refreshing roller 51 may preferably be set at about 1-5 μm.

Incidentally, the reason why the portion is set at a low level is that a driving torque tends to increase due to the direct rubbing of the surface layer of the fixing roller 21 with the metal roller, and therefore the low pressure is preferable. This depends on that an amount of deformation of the refreshing roller 51 during the rubbing is smaller than that in this embodiment (refreshing roller provided with the elastic layer) and therefore the metal roller is liable to deeply damage the fixing member.

Further, in this embodiment, power for uniformly maintaining the surface roughness of the surface layer of the fixing roller 21 for a long term by rubbing tends to be inferior to the refreshing roller 51 containing the rubbing material in the above-described embodiments, but the constitution itself can be simplified. For that reason, a degree of deterioration of the surface of the refreshing roller 51 is small and thus the rubbing can be carried out frequently.

In this way, even in the constitution in this embodiment in which the surface roughness and the contact pressure applied to the fixing roller 21 are low, the surface property of the fixing roller 21 can be maintained for a long term.

Incidentally, as a fear in the case of this embodiment, it would be considered that the contaminant such as the abrasion debris of the PFA resin constituting the toner parting layer of the fixing roller 21, the offset toner or the paper powder is liable to be clogged in the recessed portions of the refreshing roller 51. However, also in this embodiment, similarly as in the embodiments described above, the contaminant can be removed by blowing the air onto the refreshing roller 51, and therefore the rubbing of the fixing roller 21 can be properly carried out for a long term.

Other Embodiments

1) In the above, the embodiments in which the surface property of the fixing roller is substantially recovered (i.e., in which the surface roughness is maintained within a predetermined range with respect to the longitudinal direction) by rubbing the fixing roller with the refreshing roller 51 were described, but the present invention is not limited thereto. For example, the present invention is similarly applicable to an embodiment in which the surface property of the pressing roller (second rotatable member) is substantially recovered by rubbing the pressing roller with the refreshing roller 51.

2) The image heating apparatus according to the present invention is not limited to use as the fixing device as in the above-described embodiments. The image heating apparatus can also be used as a glossiness adjusting apparatus (image modifying apparatus) for adjusting surface glossiness of an image by re-heating a toner image which is partly fixed or fixed on a recording material (recording paper).

3) The rotatable heating member for heating the image on the recording material is not limited to the roller member. The rotatable heating image may also be a cylindrical flexible belt member or a flexible endless belt which is stretched around a plurality of stretching members and which is rotationally driven.

4) Also the rotatable pressing member for forming the nip with the rotatable heating member is not limited to the roller member but may also be a belt member. Further, a non-rotatable member may also be used. That is, the non-rotatable member such as a pad or a plate-like member having small friction coefficient at a surface as a contact surface with the rotatable heating member or the recording material can also be used.

5) The heating mechanism for heating the rotatable heating member or the pressing member is not limited to the halogen heater in the above-described embodiments. It is also possible to use other heating means of an internal or external heating type, such as a ceramic heater, an electromagnetic induction coil and an infrared lamp.

6) The fixing device in the present invention may also be carried out in an image forming apparatus, other than the color electrophotographic printer as in the above-described embodiments, such as a monochromatic copying machine, a facsimile, a monochromatic printer or a multi-function machine of these machines. That is, the fixing device and the color electrophotographic printer in the above-described embodiments are not limited to combinations of the above-described constituent members but may also be realized in other embodiments in which a part or all thereof are replaced with their alternative members.

7) The image forming type of the image forming portion of the image forming apparatus is not limited to the electrophotographic type but may also be an electrostatic recording type or a magnetic recording type. Further, the image forming type is not limited to the transfer type but may also be a type in which the image is formed on the recording material by a direct type.

8) In the present invention, the air includes gas, other than the air, such as nitrogen gas or carbonic acid gas.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 049096/2013 filed Mar. 12, 2013 which is hereby incorporated by reference.

What is claimed is:

1. An image heating apparatus comprising:

first and second rotatable members configured to form a nip for heating a toner image on a recording material;

a rotatable rubbing member configured to rub an outer surface of said first rotatable member to substantially refresh a surface property of said first rotatable member; and an air blowing mechanism is configured to turn on and off to blow air intermittently onto said rotatable rubbing member to clean said rotatable rubbing member.

2. An image heating apparatus according to claim 1, further comprising a controller configured to execute rubbing by said rotatable rubbing member and cleaning by said air blowing mechanism when there is no recording material at the nip.

3. An image heating apparatus according to claim 2, wherein said controller executes the rubbing and the cleaning in parallel.

4. An image heating apparatus according to claim 1, wherein said air blowing mechanism includes an air nozzle configured to blow the air onto said rotatable rubbing member.

5. An image heating apparatus according to claim 4, further comprising a cleaning mechanism configured to clean said first rotatable member in contact with said first rotatable member, wherein a direction of the air from said air nozzle toward said rotatable rubbing member is tilted toward said cleaning mechanism with respect to a direction toward a center of said rotatable rubbing member.

6. An image heating apparatus according to claim 5, wherein said cleaning mechanism includes a cleaning web configured to be refreshed by feeding a cleaning surface by a predetermined amount, wherein said cleaning web has a surface, onto which the air from said air nozzle is blown, in a downstream side of a feeding direction of said cleaning web.

7. An image heating apparatus according to claim 6, wherein said cleaning member includes a rotatable collecting member configured to collect a toner in contact with said first rotatable member, wherein said cleaning web contacts said rotatable collecting member to clean said rotatable collecting member.

8. An image heating apparatus according to claim 1, further comprising a cleaning member configured to clean said rotatable rubbing member in contact with said rotatable rubbing member, wherein the affinity of said rotatable rubbing member for the toner is higher than the affinity of said first rotatable member for the toner, and the affinity of said cleaning member for the toner is higher than the affinity of said rotatable rubbing member for the toner.

9. An image heating apparatus according to claim 8, wherein said cleaning member includes an elastic layer at a surface thereof.

10. An image heating apparatus according to claim 1, wherein said first rotatable member is provided in a side where said first rotatable member contacts the toner image on the recording material.

11. An image heating apparatus comprising:

first and second rotatable members configured to form a nip for heating a toner image on a recording material;

a rotatable rubbing member configured to rub an outer surface of said first rotatable member so that a surface roughness Rz of said first rotatable member is 0.5 to 2.0 μm;

a driving mechanism configured to drive said rotatable rubbing member so that a difference between the peripheral speed of said first rotatable member and the peripheral speed of said rotatable rubbing member is generated; and an air blowing mechanism is configured to turn on and off to blow air intermittently onto said rotatable rubbing member to clean said rotatable rubbing member.

12. An image heating apparatus according to claim 11, wherein when said driving mechanism drives said rotatable rubbing member so that the peripheral speed ratio of said rotatable rubbing member relative to said first rotatable member is in a range of 50% or more and 100% or less when surface movement directions of said rotatable rubbing member and said first rotatable member are opposite to each other.

13. An image heating apparatus according to claim 11, wherein when said driving mechanism drives said rotatable rubbing member so that the peripheral speed ratio of said rotatable rubbing member relative to said first rotatable member is in a range of 250% or more and 300% or less when surface movement directions of said rotatable rubbing member and said first rotatable member are the same.

14. An image heating apparatus according to claim 11, further comprising a controller configured to execute rubbing by said rotatable rubbing member and cleaning by said air blowing mechanism when there is no recording material at the nip.

15. An image heating apparatus according to claim 14, wherein said controller executes the rubbing and the cleaning in parallel.

16. An image heating apparatus according to claim 15, wherein said air blowing mechanism effects the cleaning by intermittently blowing the air onto said rotatable rubbing member.

17. An image heating apparatus according to claim 11, wherein said air blowing mechanism includes an air nozzle configured to blow the air onto said rotatable rubbing member.

18. An image heating apparatus according to claim 17, further comprising a cleaning mechanism configured to clean said first rotatable member in contact with said first rotatable member, wherein the direction of the air from said air nozzle toward said rotatable rubbing member is tilted toward said surface layer mechanism with respect to a direction toward a center of said rotatable rubbing member.

19. An image heating apparatus according to claim 18, wherein said cleaning mechanism includes a cleaning web configured to be refreshed by feeding a cleaning surface by a predetermined amount, wherein said cleaning web has a surface, onto which the air from said air nozzle is blown, in a downstream side of a feeding direction of said cleaning web.

20. An image heating apparatus according to claim 19, wherein said cleaning member includes a rotatable collecting member configured to collect a toner in contact with said first rotatable member, wherein said cleaning web contacts said rotatable collecting member to clean said rotatable collecting member.

21. An image heating apparatus according to claim 11, further comprising a cleaning member configured to clean said rotatable rubbing member in contact with said rotatable rubbing member, wherein the affinity of said rotatable rubbing member for the toner is higher than the affinity of said first rotatable member for the toner, and the affinity of said cleaning member for the toner is higher than the affinity of said rotatable rubbing member for the toner.

22. An image heating apparatus according to claim 21, wherein said cleaning member includes an elastic layer at a surface thereof.

23. An image heating apparatus according to claim 11, wherein said first rotatable member is provided on a side where said first rotatable member contacts the toner image on the recording material.

* * * * *